United States Patent [19]

Blankemeyer et al.

[11] Patent Number: 4,872,419

[45] Date of Patent: Oct. 10, 1989

[54] TRANSPORTABLE COATING APPARATUS

[75] Inventors: Robert L. Blankemeyer, Fort Jennings; James C. Blankeyemer, Columbus Grove, both of Ohio

[73] Assignee: Metokote Corporation, Lima, Ohio

[21] Appl. No.: 924,515

[22] Filed: Oct. 29, 1986

[51] Int. Cl.[4] ..... B05C 11/00

[52] U.S. Cl. ..... 118/713; 118/58; 118/64; 118/425; 118/429; 118/DIG. 7

[58] Field of Search ..... 118/58, 64, 73, 326, 118/425, 429, 713, DIG. 7; 134/61, 66, 74, 76, 82, 83; 160/265, 310, 311, 315, 323 B, 323 R, DIG. 8

[56] References Cited

U.S. PATENT DOCUMENTS

| | | | |
|---|---|---|---|
| 2,789,569 | 4/1957 | Davis | 134/58 R |
| 2,928,401 | 3/1960 | Finston | 134/58 R |
| 3,236,680 | 2/1966 | Hnot | 118/64 |
| 3,460,602 | 8/1969 | Hugus | 160/265 |
| 3,658,197 | 4/1972 | DiDonato | 414/564 |
| 4,096,300 | 6/1978 | William et al. | 118/72 X |
| 4,377,986 | 3/1983 | Juve | 118/425 |
| 4,483,718 | 11/1984 | Bross et al. | 134/83 |
| 4,532,886 | 8/1985 | Bouchard | 118/326 |
| 4,562,791 | 1/1986 | Porter et al. | 118/DIG. 7 |

OTHER PUBLICATIONS

Process Automation & Technology, Inc. brochure, "Process Beam System", (1981).

*Primary Examiner*—Shrive Beck
*Assistant Examiner*—Alain Bashore
*Attorney, Agent, or Firm*—Bernard, Rothwell & Brown

[57] ABSTRACT

A transportable treatment apparatus includes a multi-compartment unitary tank mounted within a support structure along with an oven extending over the tank area as well as tank circulation means upon a side support wherein the support is attachable at opposite ends to a respective wheeled carrier device and a track coupling trailer device so that the assembled unit may be transported down a roadway.

6 Claims, 24 Drawing Sheets

TRANSPORTABLE COATING APPARATUS

BACKGROUND OF THE INVENTION

1. Technical Field

The present invention relates to apparatus for coating articles, and particularly to coating apparatus for forming coatings of epoxy or other synthetic resin or paint on steel or other metal articles requiring protection against corrosion or requiring insulation, or other treatment.

2. Description of the Prior Art

The prior art contains many coating apparatus wherein articles are dipped in a series of tanks containing cleaning, precoating coating, and post-coating treatment solutions to produce a film or deposit of liquid or particulate coating material thereon. The articles are then passed through an oven where the coating is dried and cured to form a durable corrosion resistant or insulative layer on the article.

In one typical prior art apparatus, a plurality of tanks containing various treating fluids are disposed along a linear path above which is mounted an elongated oven. A conveyor track section which is movable between raised and lowered positions extends over the tanks for immersing batches of articles carried by carriers on the conveyor track. The articles are loaded upon the carriers at a front station of the coating apparatus, and the loaded carriers are pushed along the track section in increments by a pawl mechanism when the track section is raised so as to advance the carriers sequentially to each tank. A typical arrangement of tanks includes one or more initial tanks for cleaning the metal articles, for example a first tank containing water or detergent along with ultrasonic facilities for removing heavy soil, particles, and the like, a second tank containing a stronger cleaner such as an acid bath for removing contaminant films and other impurities, and a third tank containing a water rinse. This is followed by several tanks containing respective precoating treatment solutions such as a surface conditioner, a zinc phosphate treatment, a water rinse, a sealer and deionized water rinsing baths prior to the coating bath which can be an electrocoating bath containing a suspension of epoxy and other resin particles. Several permeate wash baths and/or sprays are in the last several tanks.

The apparatus includes an elevator at the rear end of the apparatus for raising each carrier, as it is advanced from the last tank, upward into the oven wherein the carriers are incrementally advanced along a stationary conveyor track from the rear to the front by a pawl mechanism operated in synchronism with the advancement of the carriers on the lower track. A burner mounted at the rear of the oven heats the air in the over while an externally mounted return duct and circulating fan provide for air circulation from the back to the front of the oven. The oven has a front opening which is closed between carrier advancing periods by a collapsible door formed by a plurality of rigid horizontal strips which, when raised, close the front opening, and which, when lowered, collapse to permit the next carrier to exit the front opening of the oven. At the front of the apparatus, an elevator is provided for receiving each carrier as it exits the oven and for lowering each carrier to the work area where the articles with completed coatings are removed from the carriers and new articles to be treated are placed thereon. Additionally, the typical prior art facility contains air exhaust systems for withdrawing excess air from the oven in order to maintain proper drying and curing conditions, and for withdrawing heated air from the work area to provide comfortable working conditions for workers in the loading area.

The prior art coating apparatus utilized in relatively large scale commercial production facilities are generally designed and assembled at the location where they are employed. Tools, equipment and trained personnel are often required to travel long distances in order to manufacture and/or assemble various components of the coating apparatus at the plant location. For these reasons, costs of installing a coating apparatus for employment in a commercial scale operation are relatively high. This relatively high cost inhibits employment of coating processes on many articles and/or further increases costs due to shipment of articles to other locations where the volume of articles being coated warrants the expense of the coating apparatus. Additionally, if a plant location is closed, the disassembly, shipment of disassembled parts and reassembly at a new plant location is expensive.

SUMMARY OF THE INVENTION

The present invention is summarized in a coating apparatus which may be transported, in an assembled conditions, from one location to another location located a relatively long distance away over public roadways with a minimum amount of assembly at the new location. The coating apparatus includes a support structure with lower and upper horizontal frames, a multi-compartment tank having a series of tank compartments arranged along a straight line mounted on the lower frame, an oven mounted on the upper frame, a vertically movable track facility extending over the tanks and along which carrier can be incrementally moved, together with tank fluid circulating facilities mounted on a frame member extending on one side of the multi-compartment tanks. The supporting structure is adapted for being connected, at one end, to a ground-engaging wheel support, and, at the other end, to a truck trailer connecting device for enabling connecting of the apparatus to a truck tractor to thus form a trailer structure out of the coating apparatus suitable for being pulled by the truck tractor along the roadway.

An object of the invention is to produce a relatively low cost commercial scale coating apparatus.

Another object of the invention is to reduce design and assembly costs for coating apparatus.

One advantage of the invention is that coating apparatuses may be manufactured in a factory setting particularly designed for the manufacture and assembly of such coating apparatuses with the manufactured coating apparatuses then being transported to various remote locations to avoid the expense of designing, manufacture and assembly of coating apparatus at the various remote locations.

Still another advantage of the invention is that a coating apparatus, when no longer required at a plant location, can be readily moved to a new location where the coating apparatus can be employed without incurring large costs for disassembly and reassembly of the parts of the coating apparatus.

Other features of the invention include the provision of a dual level elevator at a loading station to enable the positioning of an article carrier at a level suitable for insertion of parts therein; the provision of an inspection station at the rear end of the coating apparatus to enable inspection and removal of improperly coated articles prior to the curing of the coating applied thereto; the provision of an extended work area and dual elevators at a loading station to provide an extended time for loading of articles on carriers; the provision of a burner within the entrance of a return air plenum so that air mixing in the return air plenum provides more uniform heat for curing article coatings in the oven curing chamber; and the provision of a roll-up door formed with a flexible sheet, such as a silicone-coated fiberglass, for closing the exit end of the oven between carrier advancing periods.

DESCRIPTION OF THE PREFERRED EMBODIMENT

Figure 1:
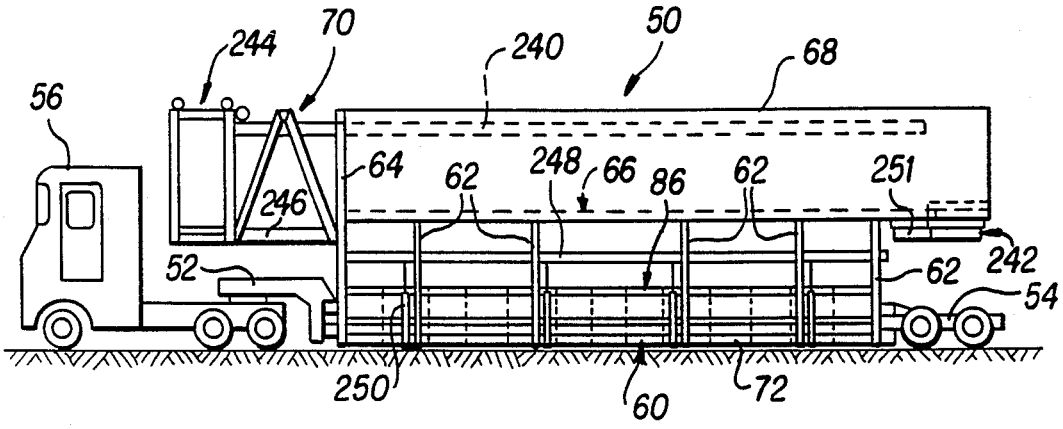
FIG. 1 is a side elevation view of a coating apparatus being transported on a roadway in accordance with the present invention.

One embodiment of a coating apparatus in accordance with the invention is illustrated generally at 50 in FIG. 1. A front trailer connecting device 52 is temporarily fastened to the front of the coating apparatus 50, while a rear wheeled device 54 is temporarily connected to the rear of the coating apparatus for supporting the rear in a raised position. The front trailer connecting device 52 is designed to be supported and connected to a truck tractor 56 so that the coating apparatus 50 may be transported over roadways from one location to another location. In particular, the coating apparatus 50 can be made in a factory location designed particularly for manufacturing such coating apparatus, and then the coating apparatus can then be attached to the devices 52 and 54 and moved by the truck tractor 56 to the plant location where the coating apparatus will be utilized to coat articles on a commercial scale. In the prior art, such commercial scale coating apparatus had to be manufactured at the plant location where employed necessitating many expenses involved with transporting skilled workers and equipment as well as various coating apparatus parts to remote locations. Additionally, such prior art commercial scale coating equipment could not be readily moved from one plant location to another plant location to accommodate changes in factory operation and production since the prior art apparatus would require extensive disassembly, part shipment, and reassembly at the new location.

Figure 2:
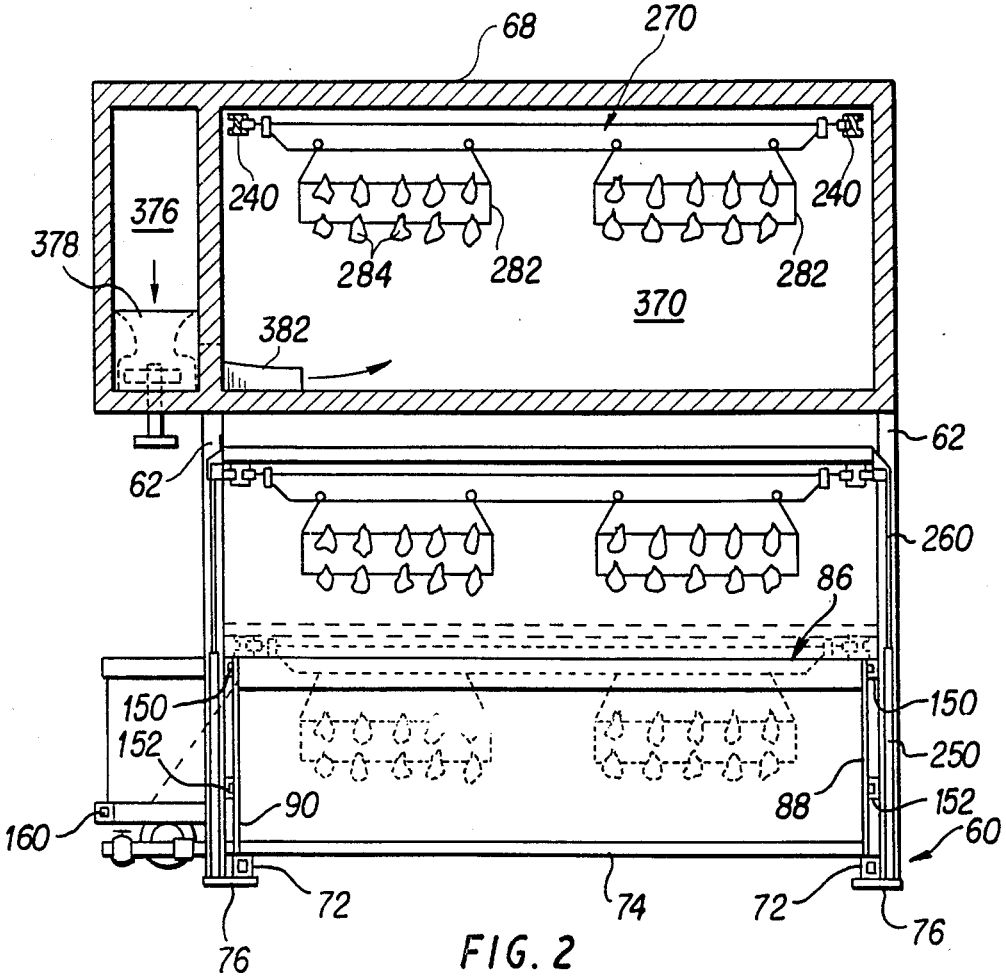
FIG. 2 is a cross-sectional elevation view of the coating apparatus of FIG. 1 in use.
Figure 21:
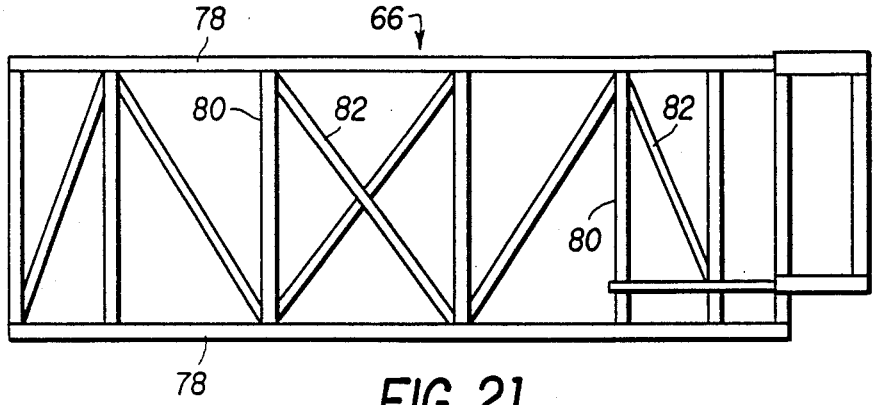
FIG. 21 is a plan view of an upper frame forming an oven base support in the apparatus of FIG. 1.

As shown in FIGS. 1 and 2, the coating apparatus includes a support structure having a bottom horizontal frame indicated generally at 60, vertical posts 62 with front-most vertical posts 64 extending upward from the bottom frame 60, and an upper horizontal frame indicated generally at 66 mounted on the posts 62 and 64 and forming the base support of an oven 68 which extends from a front elevator and work area structure indicated generally at 70 to the rear of the apparatus. The bottom frame 60 includes longitudinal horizontal side beams 72 and transverse horizontal beams 74 mounted on and extending across the space between the beams 72. Flat pads or plates 76 are mounted on the bottoms of the vertical posts 62 and 64 as well as the bottom side of the longitudinal side beams 72 for engaging and supporting the support structure on a floor. As shown in FIG. 21, the upper frame 66 includes a welded arrangement of longitudinal side beams 78, transverse beams 80 extending between the side beams 78 and diagonal beams 82 for providing rigidity and stability to the upper support structure.

Figure 3:
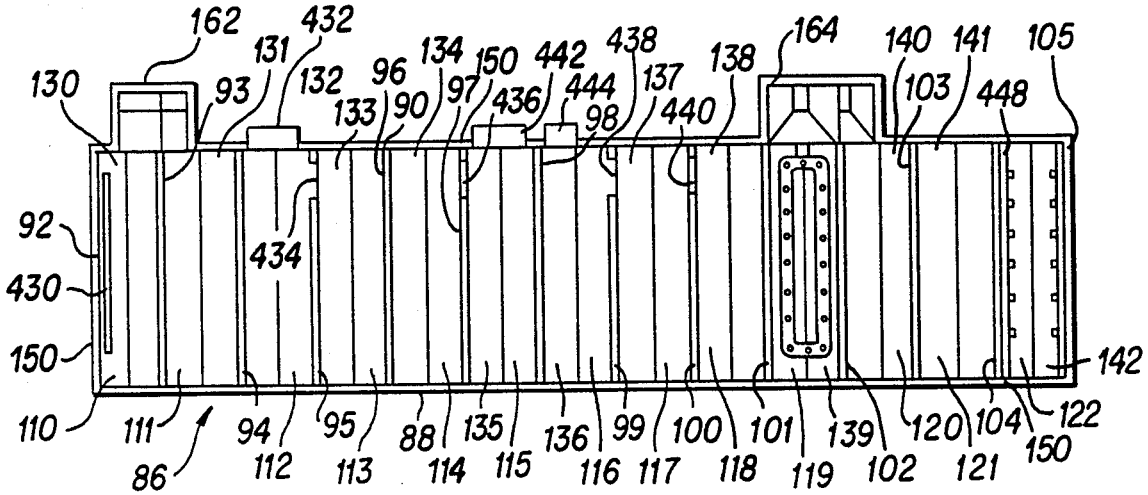
FIG. 3 is a plan view of a multi-compartmental tank in the apparatus of FIG. 1.
Figure 4:
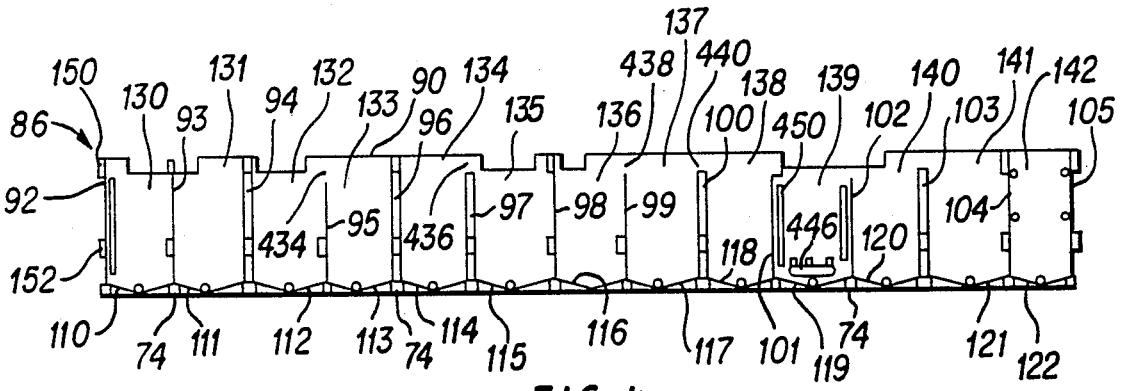
FIG. 4 is a sectional side elevation view of the tank of FIG. 3.
Figure 6:
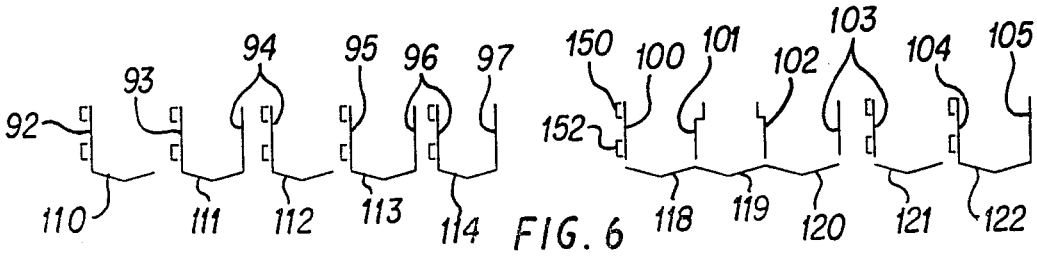
FIG. 6 is a cross-sectional exploded illustration of various types of separating panels and bottom panels used to form the compartments in the tank of FIGS. 3 and 4.

A multi-compartment tank indicated generally at 86 in FIGS. 1 and 2, is mounted on the bottom frame 60. As shown in FIGS. 2, 3 and 4, the tank 86 is formed by longitudinal side walls 88 and 90 extending from the front to the rear of the apparatus, and partitions or transverse walls 92, 93, 94, 95, 96, 97, 98, 99, 100, 101, 102, 103, 104 and 105 which are welded to the side walls 88 and 90 together with bottom panels 110, 111, 112, 113, 114, 115, 116, 117, 118, 119, 120, 121 and 122 to form thirteen tank compartments 130, 131, 132, 133, 134, 135, 136, 137, 138, 139, 140, 141 and 142. The walls 92–105 and bottoms 110–122 are formed from a variety of combinations of panels as illustrated in FIG. 6. A single metal sheet is bent in a general L shape to form the wall 92 and bottom 110. The walls 104 and 105 and bottom 122 are formed by a single sheet bent into a U shape. Some of the walls may be formed double, such as wall 94 which is formed by the right vertical panel of a single U-shaped sheet also forming wall 93 and bottom 111, together with the left vertical panel of an L-shaped metal sheet which also forms the bottom 112. Double walls may also be formed by combining two U-shaped metal sheets such as a double wall 96 formed by the U-shaped sheet forming wall 95, bottom 113 and left side of wall 96 and the U-shaped sheet forming the right side of wall 96, the bottom 114 and the right side of wall 97. Additionally, a single sheet can be used to form the bottoms of a number of adjacent compartments such as the single sheet forming the bottoms 118, 119 and 120. When a single sheet is used to form adjacent bottoms, single sheets are employed to form the transverse walls or partitions such as a single sheet forming the right-hand side of wall 100, single sheets forming walls 101 and 102, and a single sheet 103 forming the left side of wall 103. Bottom 121 is formed by a single sheet, while the right hand side of double wall 103 is also formed by a single sheet. Upper and lower reinforcing ribs 150 and 152 are formed by respective channel members welded to the periphery of the side walls 88 and 90 as well as to partition walls 92–100 and 103–105, the walls 101 and 102 being bent to form a reinforcing structure.

Figure 5:
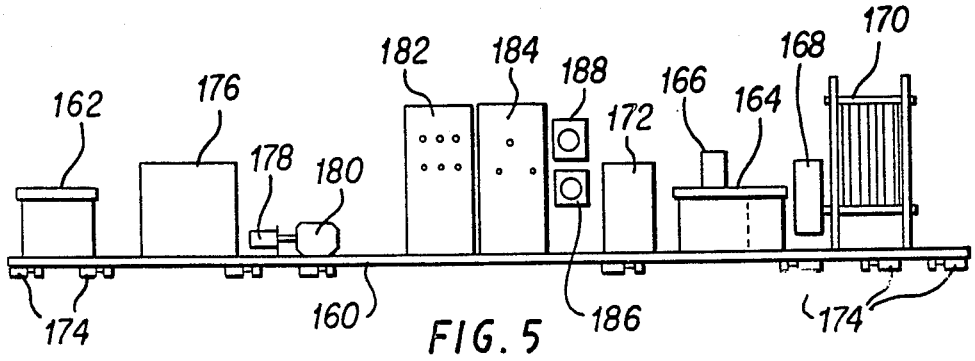
FIG. 5 is an elevational view showing an arrangement of control and fluid handling equipment in the apparatus of FIG. 1.

Referring back to FIG. 2 a longitudinal side support member 160 is mounted on the posts 62 and 64 on one side, such as the right side, and extends along the full length of the tank 86. The longitudinal side support 160 forms a support, together with various vertical and horizontal cross-members (not shown) for supporting circulation weirs, filters and pumps for various tank compartments together with hydraulic and electrical control systems. As shown in FIG. 5, there are mounted on the support 160 a double weir tank 162 for the compartments 130 and 131, double weir tank structure 164 together with coating solution circulation pump 166 for the tank compartments 139 and 140. A coating solution filter 168, a dialysis fluid tank and circulation system 172, tank circulation pumps 174, hydraulic fluid reservoir 176 together with hydraulic pump 178 and hydraulic pump motor 180, electrical control equipment cabinet 182, DC plating supply control unit 184, and chart recorders 186 and 188 for recording temperature of the plating solution and the oven are also mounted on the support 160.

Figure 7:
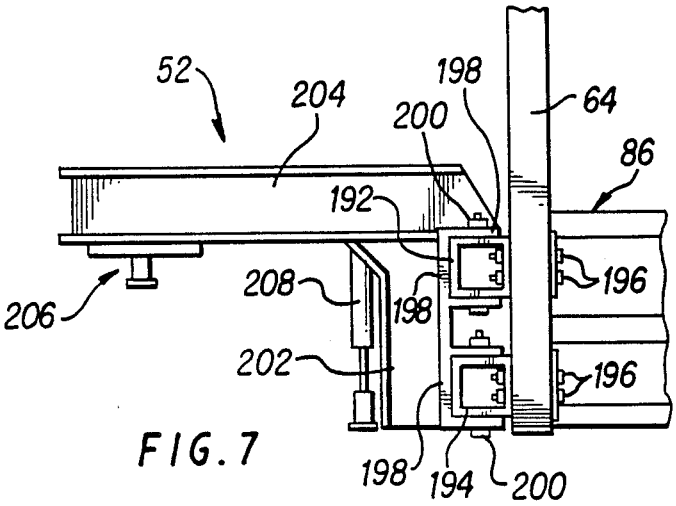
FIG. 7 is a side elevation view of a trailer coupling device attached to the front end of the coating apparatus of FIG. 1 for enabling transport from one location to another location.
Figure 8:
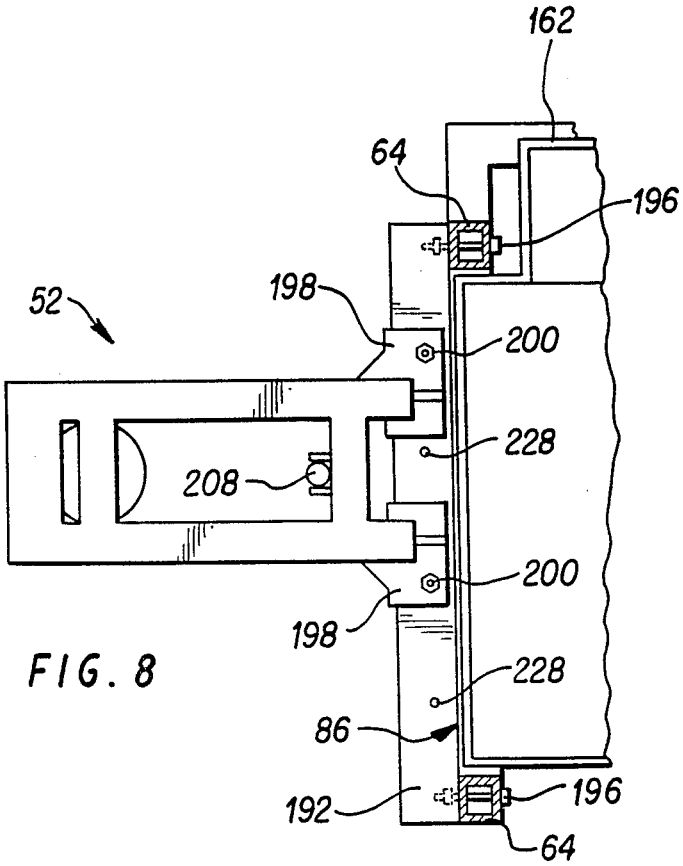
FIG. 8 is a plan view of the truck coupling device of FIG. 7.

As shown in FIGS. 7 and 8, the trailer coupling device 52 includes a pair of horizontal beams 192 and 194 which extend across the front of the tank 86 and are releasably secured at opposite ends of the beams 192 and 194 to the front post 64 by bolts 196. C-shaped members 198 are secured to the beams 192 and 194 by bolts 200. The C-shaped members 198 are mounted on the rear side of a frame portion 202 which extends downward from an upper frame portion 204 extending forward and having conventional truck mounting pin or fifth wheel structure 206 attached thereto. A hydraulic jack 208 is also mounted on the frame 204 for lifting the front end of the apparatus 50.

Figure 9:
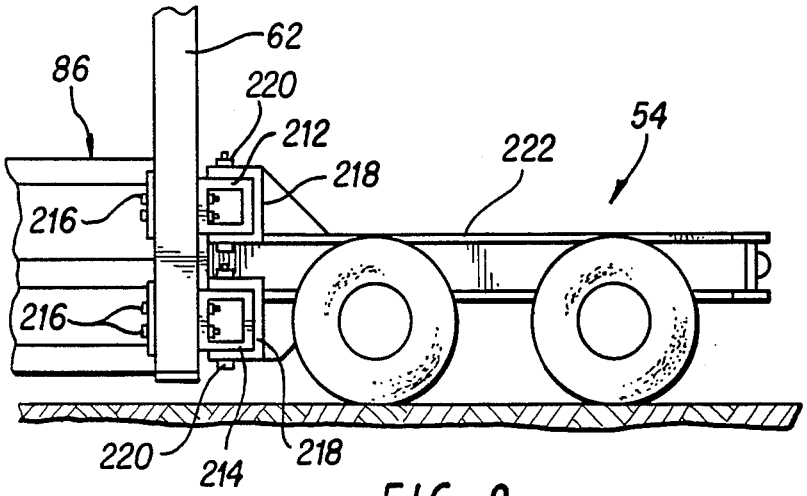
FIG. 9 is a side elevation view of a wheeled supporting device attached to the rear end of the coating apparatus of FIG. 1 for enabling transport on a roadway.
Figure 10:
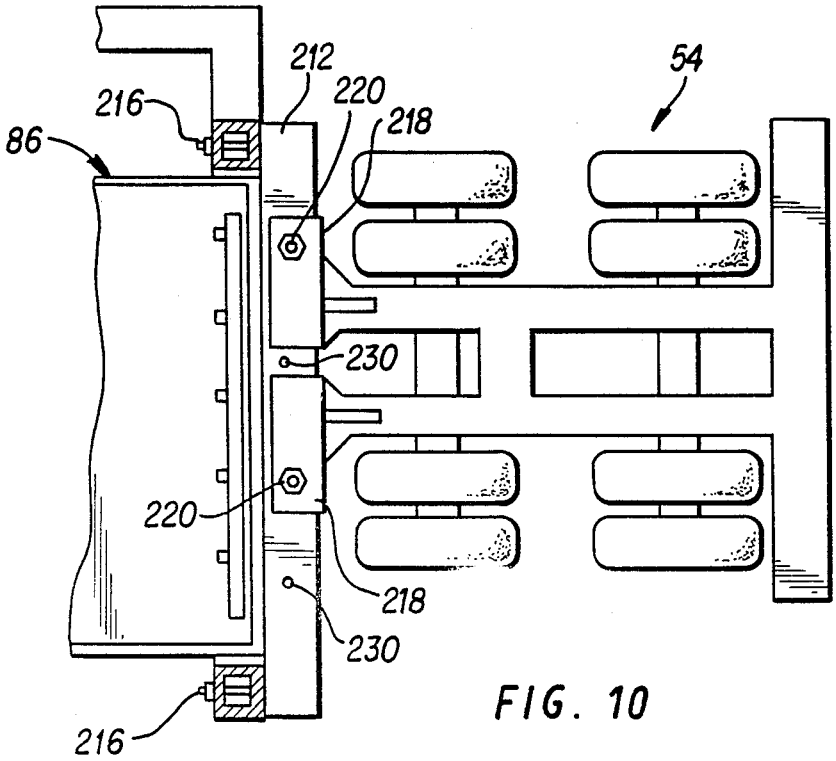
FIG. 10 is a plan view of the wheeled device of FIG. 9.

Referring to FIGS. 9 and 10, the rear wheel device 54, similar to the front device 52 includes an upper beam 212 and a lower beam 214 which extend across the rear of the tank 86 and are removably secured to the rear posts 62 by bolts 216 at opposite ends of the beams 212 and 214. C-shaped members 218 are releasably secured to the beams 212 and 214 by bolts 220. The C-shaped members 218 are mounted on the forward end of a frame 222 carried by conventional wheel and axle structures for supporting the rear end of the coating apparatus above the ground or road level.

Figure 11:
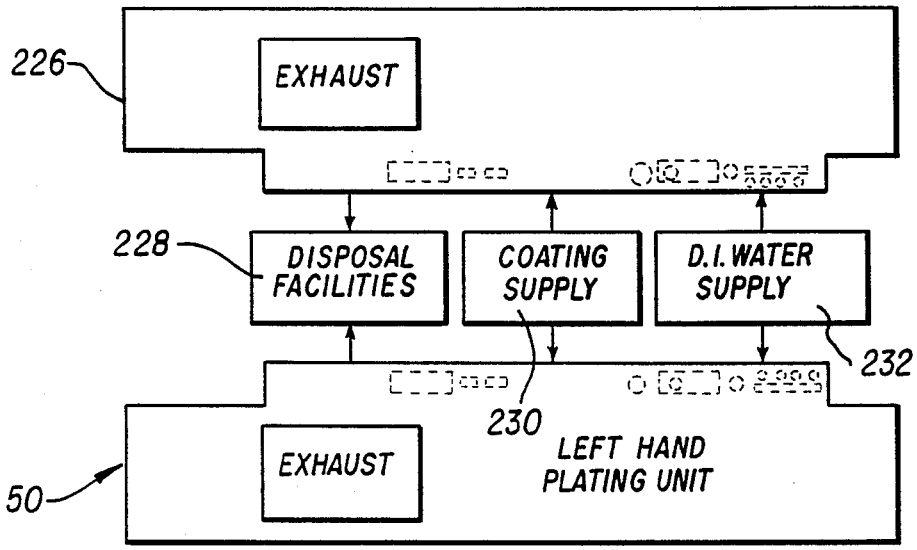
FIG. 11 is a plan view of an installed plant arrangement employing a pair of coating apparatuses in accordance with the invention.

As shown in FIG. 11, a plant coating arrangement includes the left-hand plating unit or apparatus 50 together with a right-hand plating unit 226; i.e., the unit 50 is on the left (bottom in FIG. 11) while the unit 226 is on the right (top in FIG. 11). The units 50 and 226 are mirror images of each other in that the longitudinal support 160 with associated fluid handling equipment, and hydraulic and electrical control equipment are located on the adjacent sides in the units 50 and 226 so that these two units may share waste disposal facilities 228, coating supply facilities 230, and deionized water supply facilities 232. Where the volume of articles being plated does not warrant employment of two plating apparatuses, then only one of the right-hand and left-hand plating units would be employed with the disposal facilities 228, coating supply 230 and deionized water supply 232. Having the circulation and control equipment mounted on the right side of the plating apparatus 50 causes the center of gravity of the unit 50 to be shifted to the right of a longitudinal center of the tank 86, while having this equipment on the left as in the unit 226 causes the center of gravity to be shifted to the left of the center of the tank 86. Thus, referring back to FIGS. 8 and 10, openings in the beams 192, 194, 212 and 214 through which the bolts 200 and 220 are secured are offset to the right of the center of the tank 86 so that the respective devices 52 have centers which are located generally along the center of gravity of the plating apparatus 50. Openings 228 are provided in the beams 192 and 198 while openings 230 are provided in the beams 212 and 214 offset to the left of the center of the tank so that the devices 52 and 54 may be attached to the beams with centers of the devices 52 and 54 located along a center of gravity of a right-hand plating unit 226. Thus the trailer coupling device 52 and rear wheel support device 54 can be utilized for transporting both left-hand and right-hand plating apparatuses.

Figure 15:
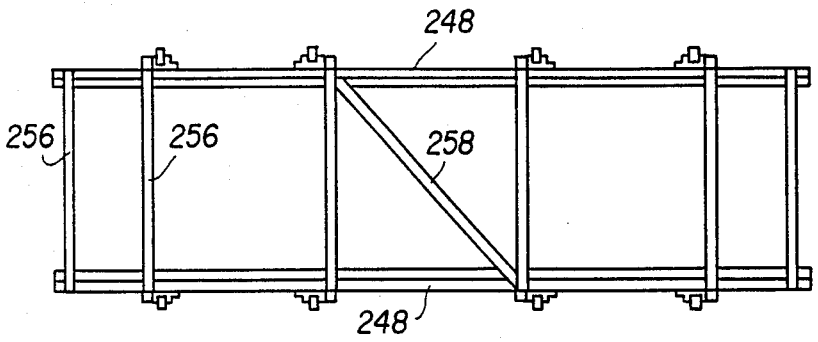
FIG. 15 is a plan view of a vertically movable track section for immersing articles in the tank in the apparatus of FIG. 1.
Figure 16:
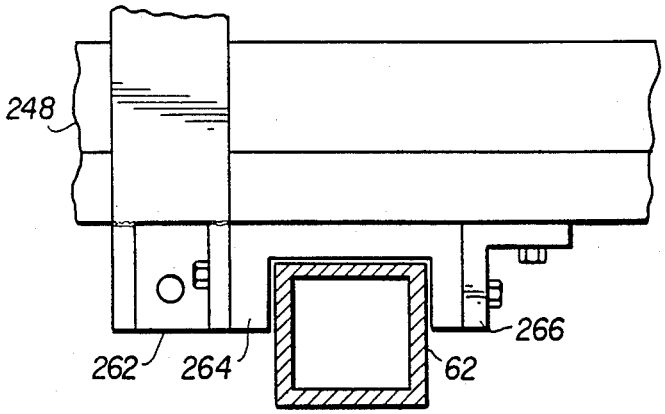
FIG. 16 is an enlarged detailed view of a guide arrangement for the track section of FIG. 15.
Figure 17:
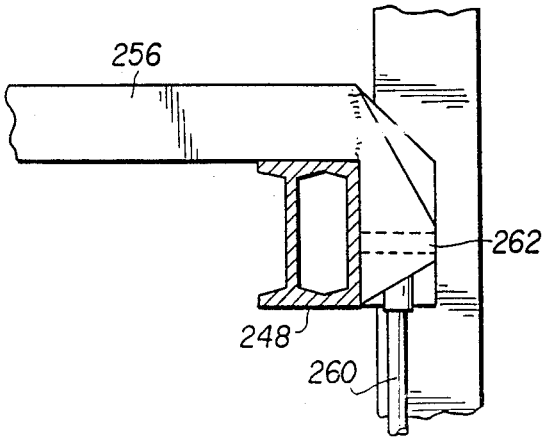
FIG. 17 is a front elevational view of the guide section of FIG. 16.
Figure 18:
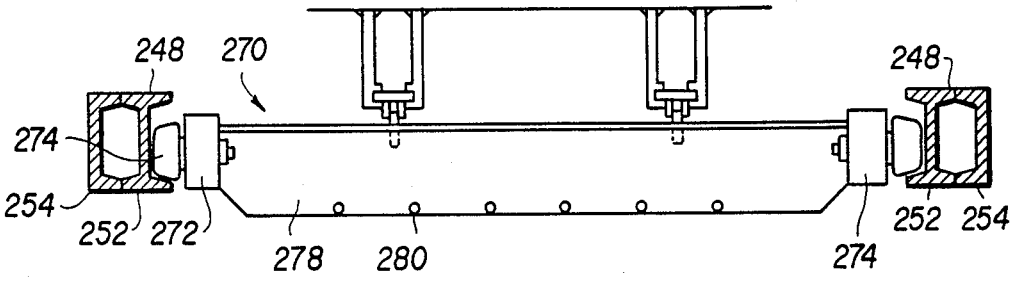
FIG. 18 is a front elevational view of an article carrier employed in the apparatus of FIG. 1.

Referring back to FIG. 1, the apparatus 50 includes upper stationary tracks 240 which extend forward from a rear elevator station 242 in the rear end of the oven 50 through the length of the oven and projects forward from the front of the oven 50 to the front elevator 244. A short lower stationary section of tracks 246 extend from the lower position of the elevator 244 backward to the front of the tanks 86. A vertically movable track section 248 is mounted on hydraulic cylinders 250 for being moved between raised and lowered positions and extends the full length of the tank 86. A short stationary track section 251 extends from the rear end of the vertically movable track section 248 to the rear elevator 242. As shown in FIG. 18 each of the rails 248 of the tank track system are formed by an I-beam 252 which is welded to a channel beam 254. The remaining track sections 240, 246 and 250 together with rails or tracks within the rear elevator 242 and 244 are formed from sections of I-beams similar to the I-beams 252. The tank track sections 248, as shown in FIG. 15, are secured by cross-beams 256 and diagonal beam 258 to form a bridge or unitary track structure. The hydraulic cylinders 250, as shown in FIG. 2, are mounted at lower ends on the pads 76 and have upward extending piston rods 260 which, as shown in FIGS. 16 and 17, are secured to mounts 262 on the tracks 248. A slide wear member and guide 264 is secured on one side to the mount 262 and on the opposite side by an angle member 266 to the tracks 248 for guiding the tracks upward and downward along the four inner posts 62 on each side of the apparatus.

Figure 19:
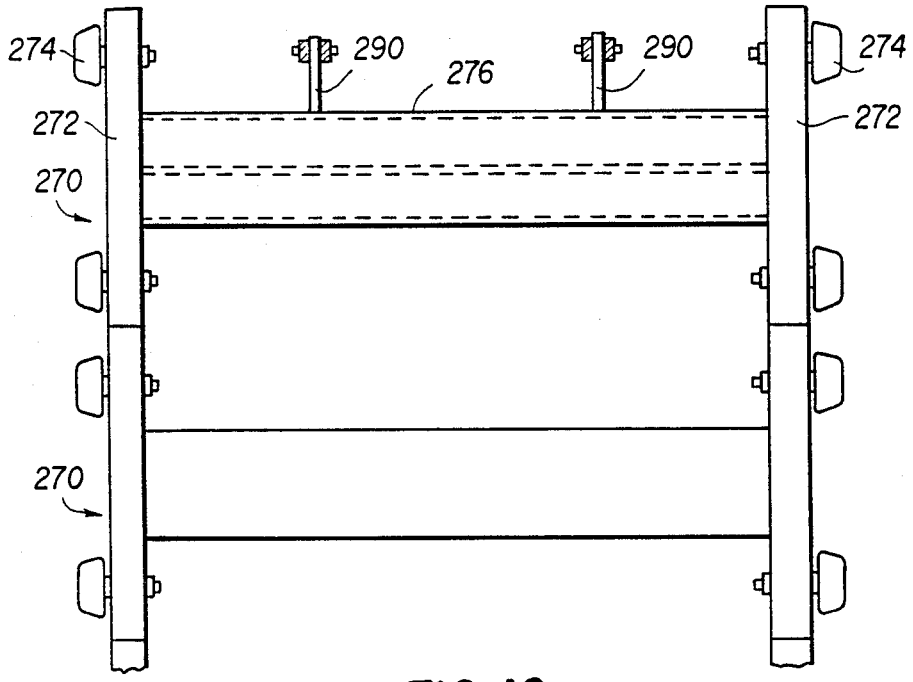
FIG. 19 is a plan view of a pair of article carriers of FIG. 18.
Figure 20:
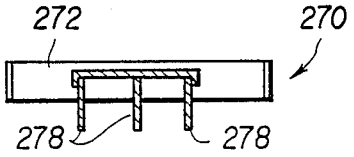
FIG. 20 is a side cross-sectional view of the article carrier of FIG. 18.

Cars or wheeled carriers indicated generally at 270 in FIGS. 18, 19 and 20 are supported on the track sections of the apparatus for carrying articles or racks containing articles to be treated and/or coated by the apparatus. Each of the cars 270 includes a pair of elongated frame members 272 on the opposite sides thereof which have four wheels 274, two wheels on each member 272 at the opposite ends thereof, for carrying the carrier 270 on the inward lower flanges of the I-beams 252. A center frame member 276 mounted at opposite ends to the center portions of the members 272 have downward extending carrier flanges 278 with openings 280 therein for carrying articles, or as illustrated in FIG. 2 for carrying racks 282 which support pluralities of articles 284 for being dipped into the compartments of the tank 86 as shown in dashed lines. The lengths of the side members 272 are equal to the widths of the compartments 130–142 of the tank 86 so that when a series of the carriers 270 are pushed from the front track section 246 onto the tank track section 248, the series of carriers will be positioned over the respective series of tank compartments 130–142.

Figure 13:
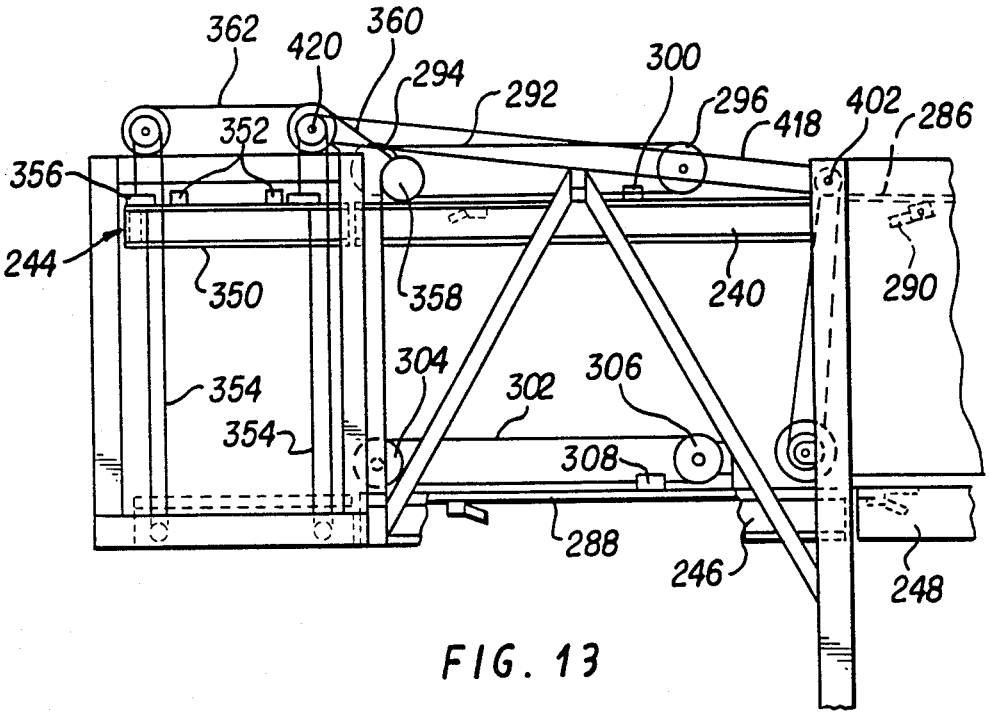
FIG. 13 is a side elevational view of a front elevator and work area section of the apparatus of FIG. 1.
Figure 14:
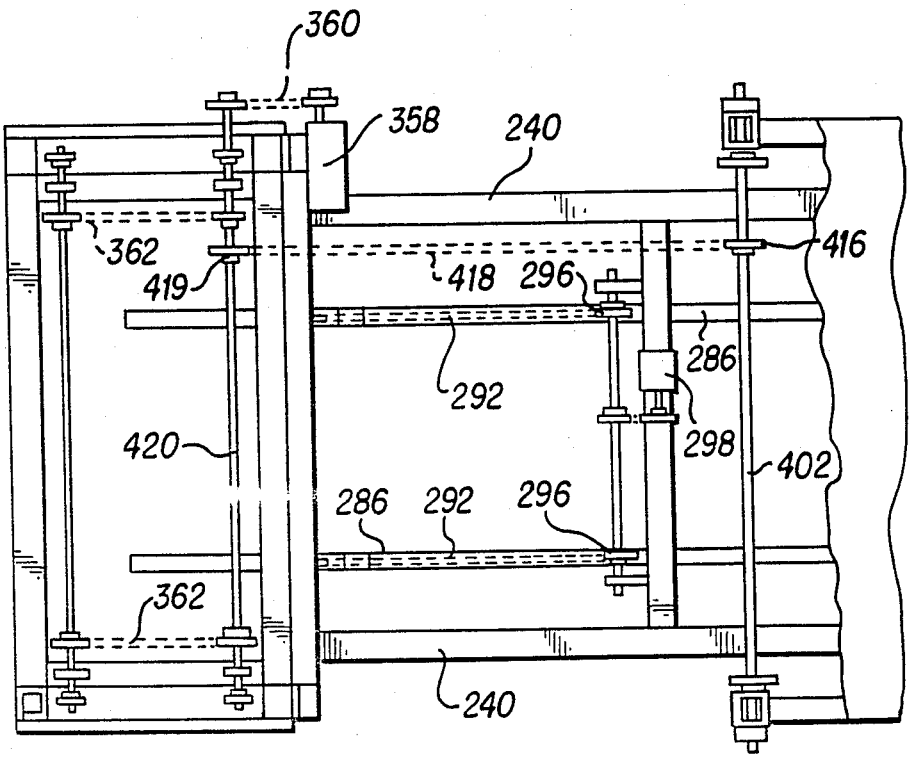
FIG. 14 is a top view of the apparatus of FIG. 13.

As illustrated in FIGS. 13 and 14, a pair of upper slide bars 286 are slidably mounted between the upper stationary rails 240, and a pair of lower slide bars 288 are slidably mounted between the lower stationary rail sections 246 above the path of the carriers 270. The slide bars 286 and 288 have gravity biased pawls 290 mounted thereon for engaging the carriers 270 and advancing them along the upper rails 240 in a direction from the right to the left as shown in FIGS. 13 and 14 and advancing the carriers 270 along the lower rails 246 and 248 from the left to the right. A pair of upper chains 292 extend around sprockets 294 and 296, the sprockets 296 being driven by reversible hydraulic motor 298, and are connected by connecting blocks 300 to the respective slide bars 286 for advancing and retracting the slide bars. Similar lower chains 302 extend around idler sprockets 304 and reversible hydraulic motor driven sprockets 306 (see hydraulic motor 307 in FIG. 31 which drives the sprockets 306) and are fastened by connecting blocks 308 to the slide bars 288 for advancing and retracting the slide bars. The upper slide bars 286 extend to the rear of the oven 50, see FIG. 25, so that carriers can be pulled from the rear elevator 242 onto the rails 240 when the elevator 242 is raised into the top of the oven. The carriers are advanced through the oven from the rear toward the front. The lower side bars 288 extend along the stationary section of the track 246 for pulling carriers from the front elevator 244 when the elevator is in a lowered position, onto the track section 246 and then pushing the carriers onto the tank track section 248 when the tank track section is in a raised position. The carriers engage each other and are pushed in a train from the front to the rear along the tank tracks 248.

Figure 25:
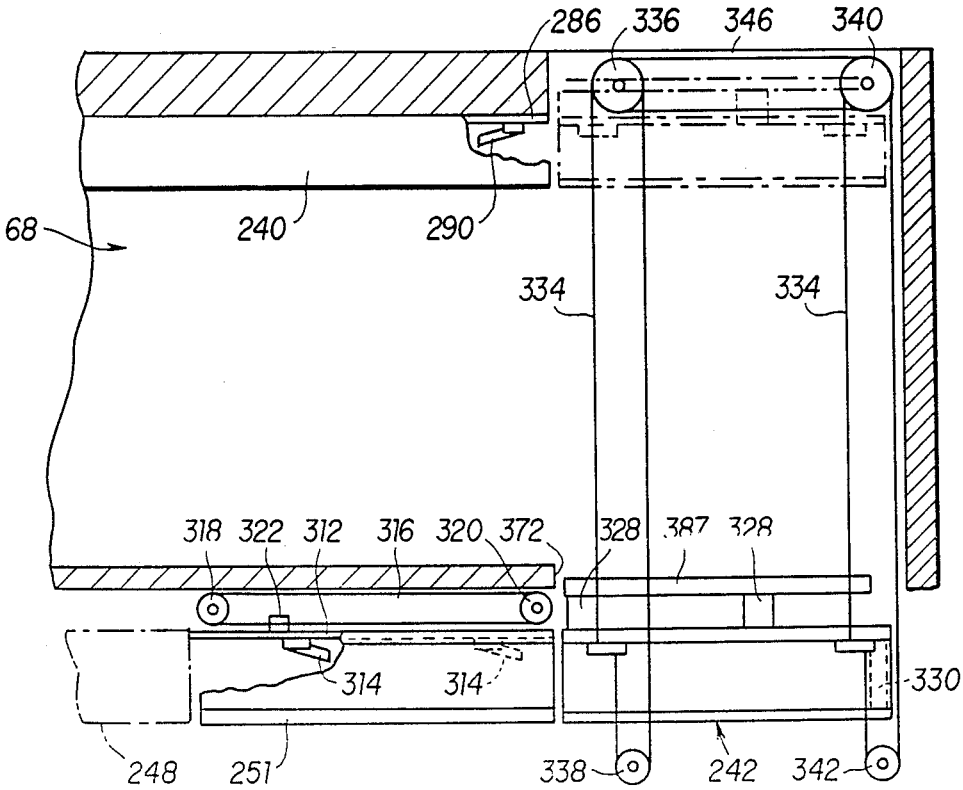
FIG. 25 is an elevational side sectional view of a rear inspection area and elevator in the apparatus of FIG. 1.
Figure 26:
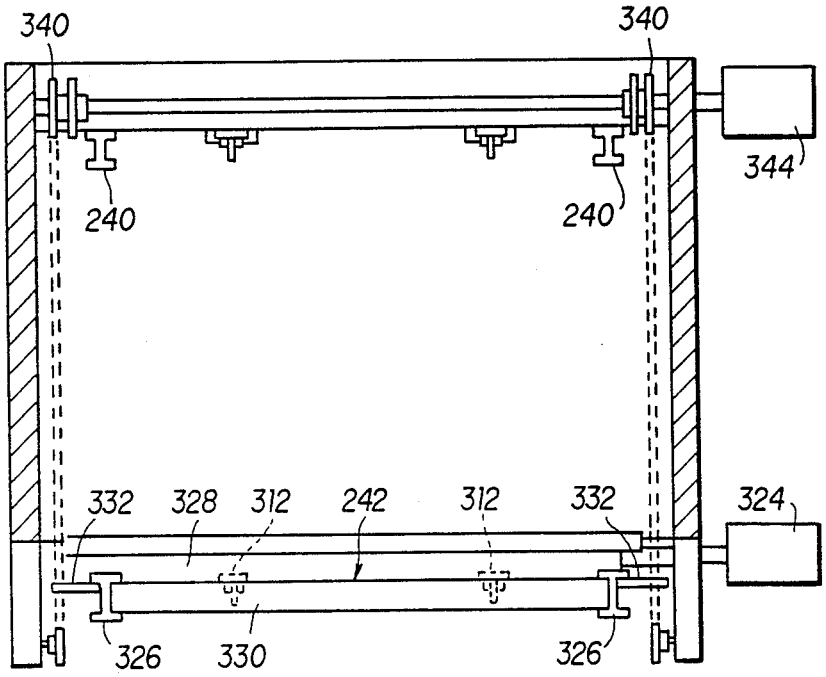
FIG. 26 is a vertical rear section view of the elevator of FIG. 25.

As shown in FIGS. 25 and 26, a pair of short slide bars 312 are slidably mounted between the rear stationary track sections 251 and have gravity biased paws 314 for engaging carriers on the short track section 251. Pairs of chains 316 extend over sprockets 318 and sprockets 320 driven by reversible hydraulic motor 324. The chains 316 are connected to the slide bars 312 by connecting blocks 322 for advancing and retracting the slide bars 312 to move the carriers from the short track section 251 into the elevator 242. The short stationary track section 251 forms an inspection station where articles having a coating applied thereto can be inspected. In the event that the coating on an article has a defect, the article can be removed from the carrier and the coating or defect removed to enable recoating or correction. For example, some articles are masked to prevent coating one or more areas, and due to a defect in the masking, coating can be erroneously applied to the areas which are supposed to be free of coating. The coating can be removed much easier prior to curing than after curing. Thus, the rear inspection station provides improved operation.

The rear elevator 242, as shown in FIGS. 25 and 26 has a pair of side rail sections 326 aligned with the respective stationary rail sections 251 and secured together by upper beams 328 as well as a rear beam 330 for closing the rear end of the track sections. Four wings 332 extend outwardly from the rails 326, two wings from each of the rails 326 adjacent respective front and rear ends of each track section 326, and are secured to opposite ends of four respective chains 334. The forward chains 334 pass over upper sprockets 336 and lower idler sprockets 338 while the rear chains pass over upper sprockets 340 and lower idler sprockets 342. A reversible hydraulic motor 344 drives the upper sprockets 340, and through chains 346 drives the forward sprockets 336 for moving the elevator 242 between the lower and upper positions.

The front elevator 244 is similar to the rear elevator and, as illustrated in FIGS. 13 and 14, includes a pair of rail sections 350 which are secured together by beams 352. Four chains 354 have ends connected to respective wings 356 extending outwardly to the sides at the front and rear of the rails 350. The chains 354 are driven by a reversible hydraulic motor 358 and chains 360 and 362 for raising and lowering the front elevator 244 between upper and lower positions for receiving carriers from the upper tracks 240 and discharing carriers onto the lower tracks 246.

Figure 12:
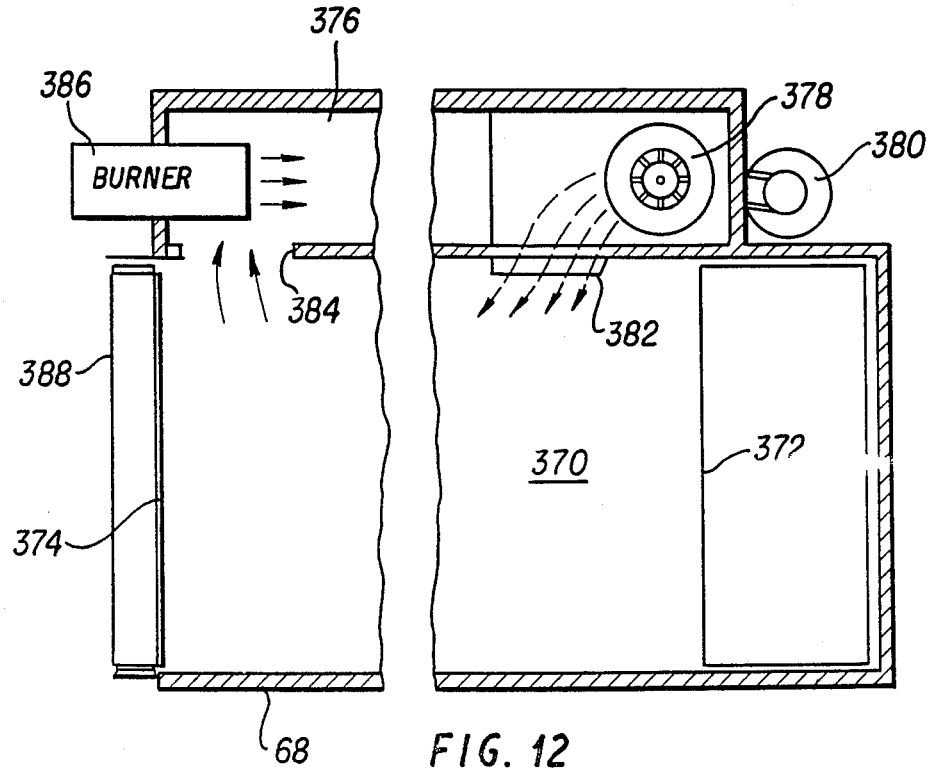
FIG. 12 is a horizontal sectional view of an oven in the apparatus of FIG. 1.

As shown in FIGS. 2 and 12, the oven 68 is formed from conventional insulated wall panels and includes a curing chamber 370 which, at the rear has an opening 372 which opens downward, and through which the rear elevator 242 passes, and at the front has an opening 374 which opens toward the front and through which the upper rails 240 extend. A return air plenum 376 is formed on one side sharing a common wall with the curing chamber and extending from the front to the back of the coating apparatus above the fluid circulating and hydraulic and electrical control equipment. A fan 378 driven by a motor 380 is mounted in the rear of the plenum 376 for discharging air from the plenum 376 through a duct 382 into the curing chamber 370. Air from the curing chamber 370 enters the plenum 378 through an opening 384 adjacent the forward end of the plenum 376. A burner 386 is mounted in the forward end of the plenum 376 for heating the air to a suitable drying and curing temperature for the coating applied to the articles. Having the hot air from the burner discharge into the front of the return plenum results in even mixing of the hot air with the circulation air to produce a more uniform curing temperature throughout the curing chamber 370.

Figure 27:
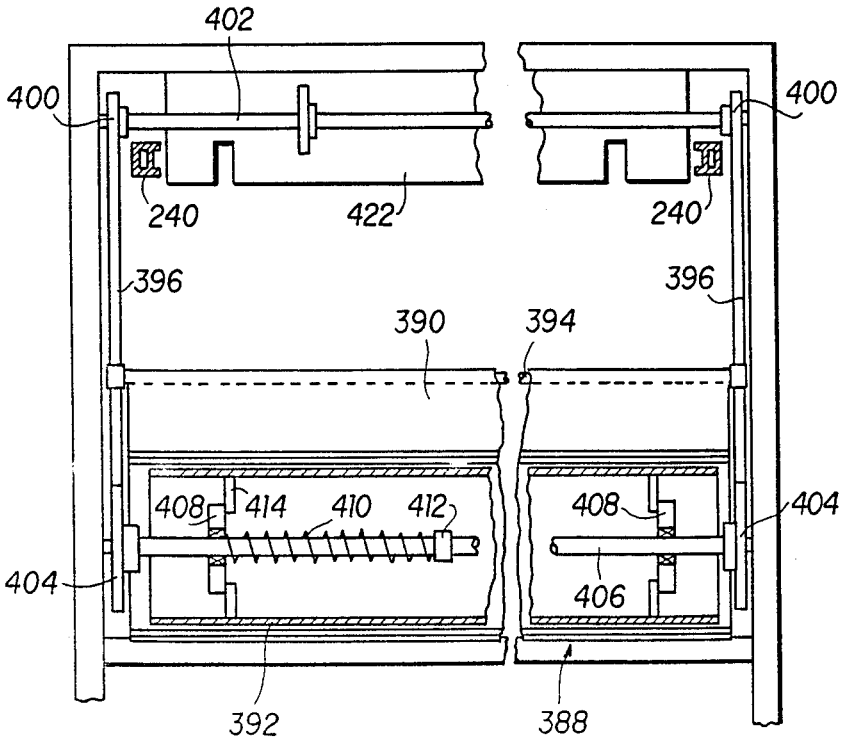
FIG. 27 is a front sectional elevational view of a roll-up door assembly for the oven in the apparatus of FIG. 1.

A panel 387, FIG. 25 mounted on the top of the elevator 342 serves to close the rear opening 372 of the oven 68 while a roll-up door 388, FIG. 12, is operated to close the front entrance 374 between increments of advancement of the carriers 270 from the oven. The roll-up door 388 as illustrated in more detail in FIG. 27 and includes a sheet 390 of high temperature resistant silicone coated fiberglass while is secured at one end to a metal pipe 392 upon which it is wound, and at the opposite end to a bar 394 which is in turn secured at opposite ends to chains 396. The chains 396 at upper ends pass over sprockets 400 on a rotatable shaft 402, and at lower ends pass over sprockets 404 mounted on a shaft 406 which extends through the center of the pipe 392. The pipe 392 is rotatably mounted by bearings 408 on the shaft 406. A helical spring 410 is fastened at one end by a connector 412 to the shaft 406 and at the opposite end to the outer portion of the bearing 408 which is fixedly attached to tabs 414 on the pipe 392. As shown in FIGS. 13 and 14, the shaft 402 has a sprocket 416 driven by a chain 418 which in turn is driven by sprocket 419 in the driven shaft 420 of the front elevator mechanism so that the roll-up door or sheet 390 is raised and lowered in synchronism with the lowering and raising of the front elevator. The spring 410 is designed to bias the pipe 392 for rolling up the sheet 390; thus, when the bar 392 is lowered by the chains 396, the sheet 390 will be rolled up on the pipe 392. Also shown in FIG. 27 is an upper flexible flap 422 of similar silicone coated fiberglass material for closing the upper portion of the front opening of the oven chamber above the rails 240.

Referring now back to FIGS. 3 and 4, the tank compartment 130 includes an ultrasonic generator 430 for aiding in the cleaning of heavy particles and soil from the articles. The tank compartment 112 includes a side weir 432, and the wall 95 between compartments 112 and 113 contains a counterflow opening 434 for providing counterflow from tank 113 into tank 112. Also walls 97, 438 and 440 contain counterflow openings 436, 99 and 100 in the upper portion thereof. Circulation weirs 442 and 444 are provided on the sides of the tank compartments 135 and 136. The coating tank compartment 139 contains an ejector 446 through which the pump 166, FIG. 5, provides sufficient circulation to maintain a suspension of epoxy particles for being electrocoated on the articles. The tank 142 contains sprayers 448 for rinsing the coating applied in the tank 139.

Figure 28:
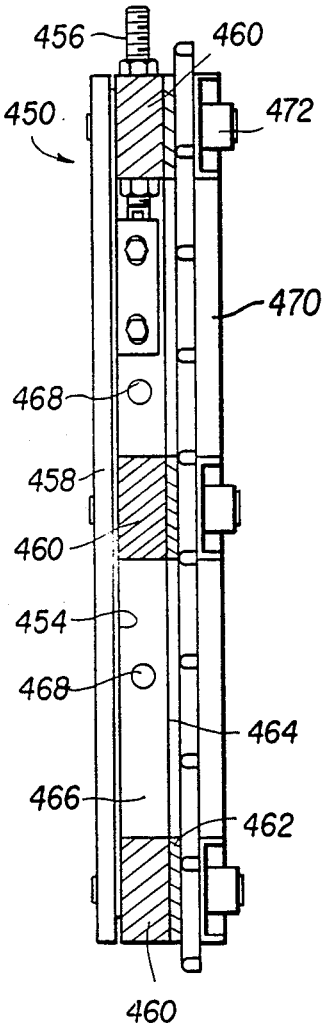
FIG. 28 is a cross-sectional view of a dialysis type electrode employed in the apparatus of FIG. 1.

The tank 139 also contains a pair of dialysis type electrodes 450 which extend within recesses in the walls 101 and 102 below upper bends forming overhangs, which electrodes serve to maintain the pH of the coating solution. As shown in FIG. 28 the dialysis type electrode includes a metal electrode sheet 454 which is connected by a connector 456 to a lead (not shown) from the DC plating control unit 184. The electrode 454 on the back side is covered by an insulative plate or back wall 458. A frame 460 is secured around the periphery of the metal sheet 454, and a membrane 464 is fastened with a front frame cover 462 to the frame 460 to form an enclosed chamber 466 defined by the plate 454, the window frame insulating structure 460 and the membrane 454. openings 468 are formed in opposite ends of the enclosed chamber for connecting to dialysis fluid supply and circulation facilities (not shown), for example a deionized water flow containing sufficient ions to enable current flow. A grid 470 is secured over the membrane with insulative bolts 472, which serve also to secure the frame 460 and 462, to prevent accidentally puncturing the membrane by an article being removed or immersed in the tank chamber. The coating is a conventional coating material, such as particulate epoxy resin material which is held in suspension in the solution and then deposited by electroplating on the articles prior to being cured in the overhead oven. The dialysis type electrodes maintain pH values of the plating solution.

Figure 29:
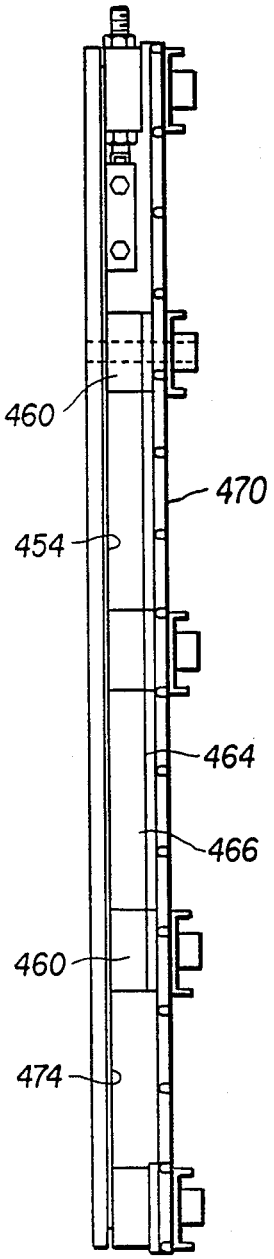
FIG. 29 is a cross-sectional view of a modified dialysis type electrode

FIG. 29 illustrates a modified dialysis type electrode wherein the membrane 464 and frame 460 form the chamber 466 only on a center portion of the metal electrode sheet 454 leaving peripheral portions 474 of the electrode sheet 454 exposed to the coating solution.

Figure 22:
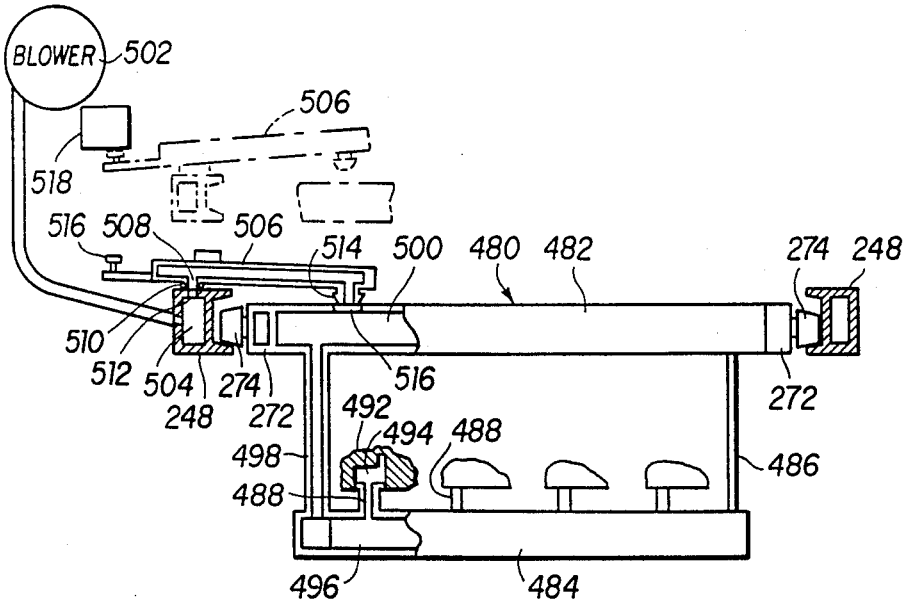
FIG. 22 is a front diagrammatic view of a modified vertically movable track section and article carrier for the apparatus of FIG. 1.
Figure 23:
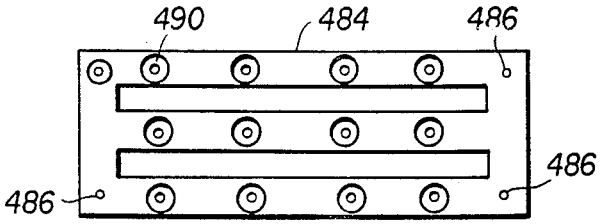
FIG. 23 is a plan view of the lower portion of the article carrier of FIG. 22.

A modified carrier indicated generally at 480 in FIGS. 22 and 23 has tubular members 480 framing the center members connected between the side members 272. Lower carrier support 484 is mounted below the upper carrier members 482 by rods 486 extending downward. Tubular posts 488 are mounted on the tubular bottom members 484 and extend upwardly to upper caps 490 which are designed to receive and support articles such as caliper parts 492 having a cavity such as a cylinder wall 494 receiving the disc 490. The tubular bottom member 484 forms an enclosed chamber 496 which communicates through a pipe 498 to a chamber 500 formed on the upper member 482.

The rail track support system 248 on one of the sides is modified as shown in FIG. 22 to include a blower 502 which communicates with an interior chamber 504 formed in the rails 248. Pivotably mounted on top of the rails 248 are a plurality of tubular arms 506 extending over the member 482 when in position at each respective tank. The tubular member 506 communicates with the chamber 504 via a passageway 508 in the tubular member 406 which communicates through seal 510 through an opening 512 in the upper side of the chamber 504. At the distal end of the tubular arm 506 the arm communicates through a resilient tubular seat 514 which, when the arm 506 is in a lowered position as shown in FIG. 22 communicates through an opening 516 to provide for air pressure in chamber 500. The air pressure in chamber 500 is transmitted through tube 498 to the lower chamber 596 where the air exits through tubular members 488 into the cylinder openings 494 in the caliper parts 492 to provide an air mask to prevent the interior walls of the cylinder 494 from being coated. When the rail 248 is raised, as shown in long and short dashed lines, an adjustable abutment 516 engages an upper frame member 518 to pivot the distal end of the arm 506 upward to raise the nipple 514 from the opening 516 and thus permit the carriers 480 to be advanced to the next tank.

Figure 24:
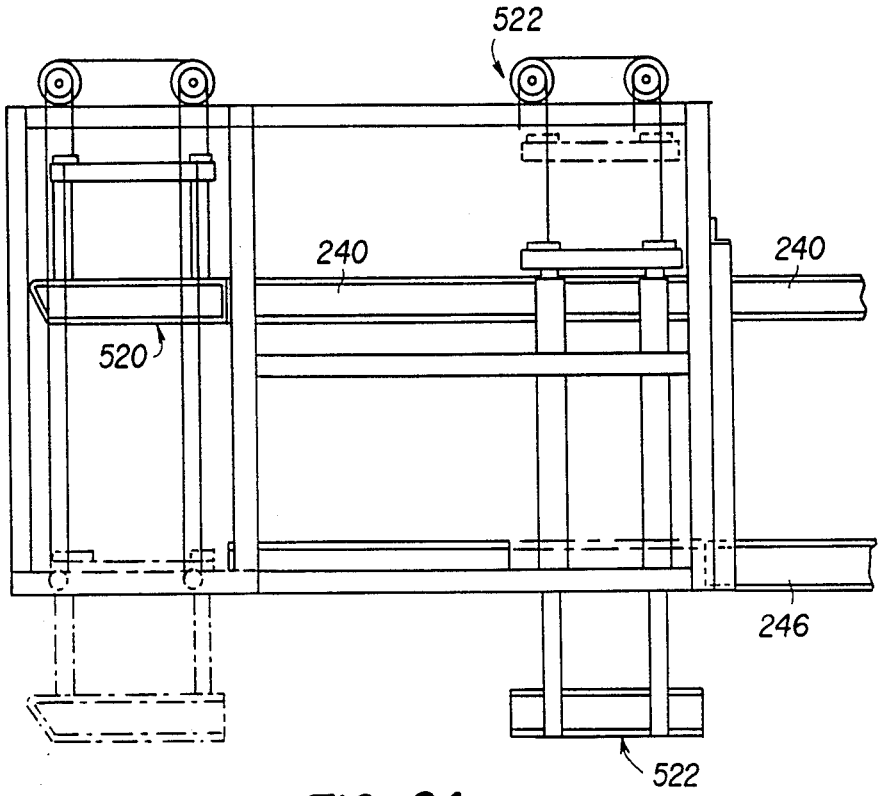
FIG. 24 is a side elevation view of a modified elevator and work area, particularly employing two elevators with the forward elevator being a three position elevator.

A modified front elevator structure and extended work area is illustrated in FIG. 24 wherein there is shown a three position front elevator indicated generally at 520 and a two position second work station elevator 522. Both the elevators are driven by their own hydraulic motor drive systems (see hydraulic motors 358 and 530 in FIG. 31) similar to the previously described front and rear elevators. Also in this modification, the rollup door 390 is driven by its own hydraulic motor 532, FIG. 31. The elevator 520 has an upper position aligned with the upper beam 240, an intermediate position aligned with the lower beam 246 and a lower position extending below the front support structure for enabling operators to more readily remove and place caliper parts upon the disc holders. The elevator 522 at the second forward position has an upper position aligned with track section 246 and a lower position enabling further loading of parts. This overcomes problems with having plating intervals which are not of sufficient length to enable operators to unload and reload articles from the carriers.

Figure 30:
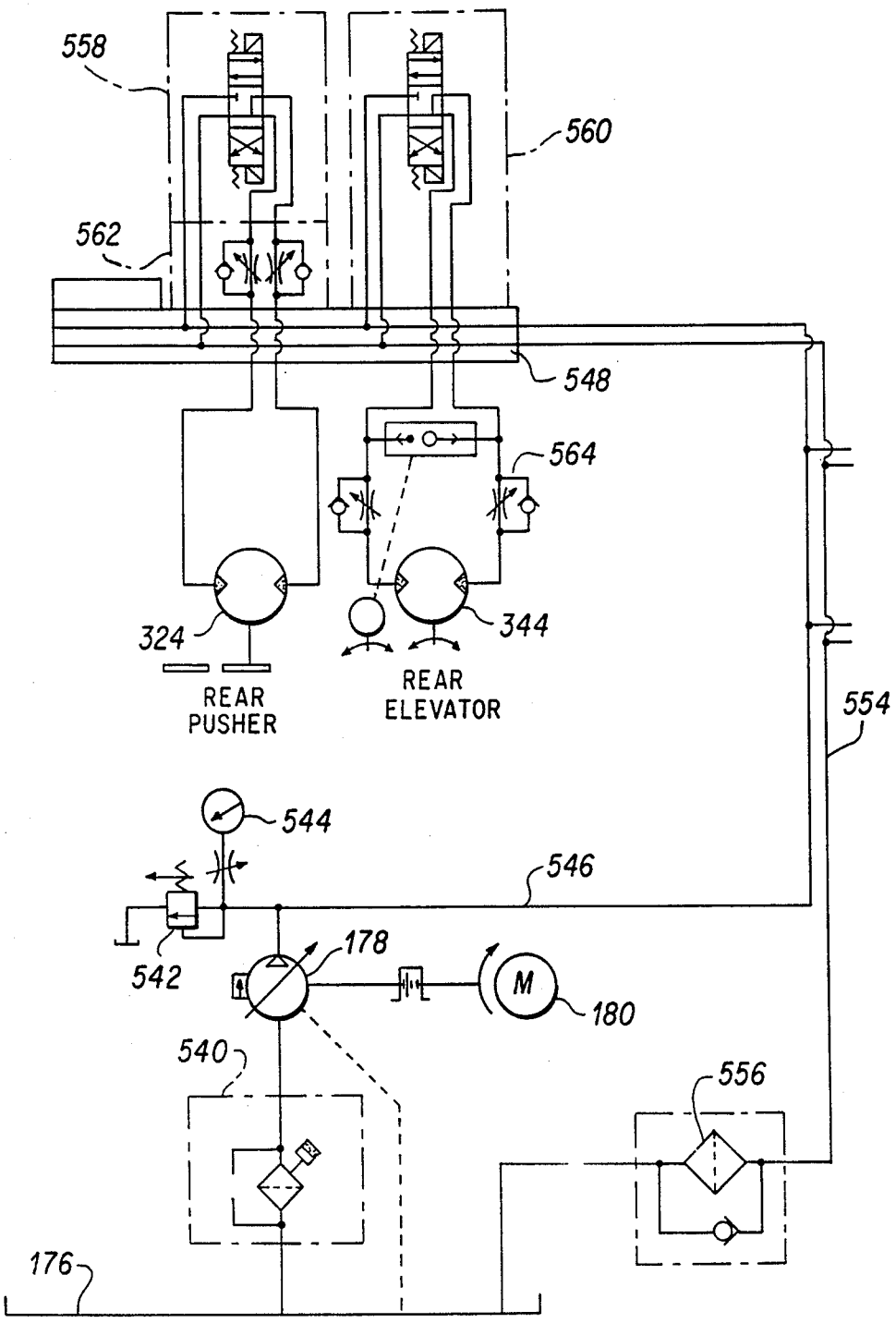
FIG. 30 is a diagram of a first portion of a hydraulic control circuit employed in the apparatus of FIG. 1.
Figure 31:
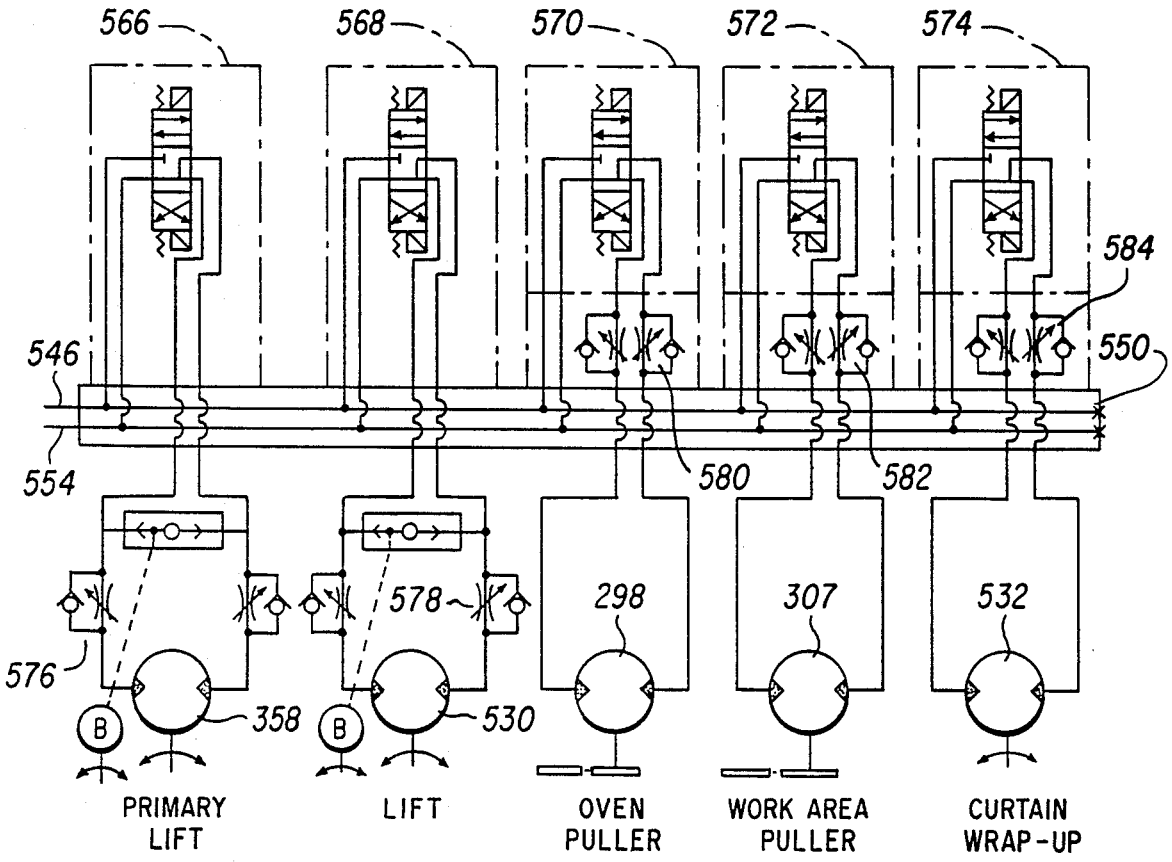
FIG. 31 is a diagram of a second portion of the hydraulic control circuit employed in the apparatus of FIG. 1.
Figure 32:
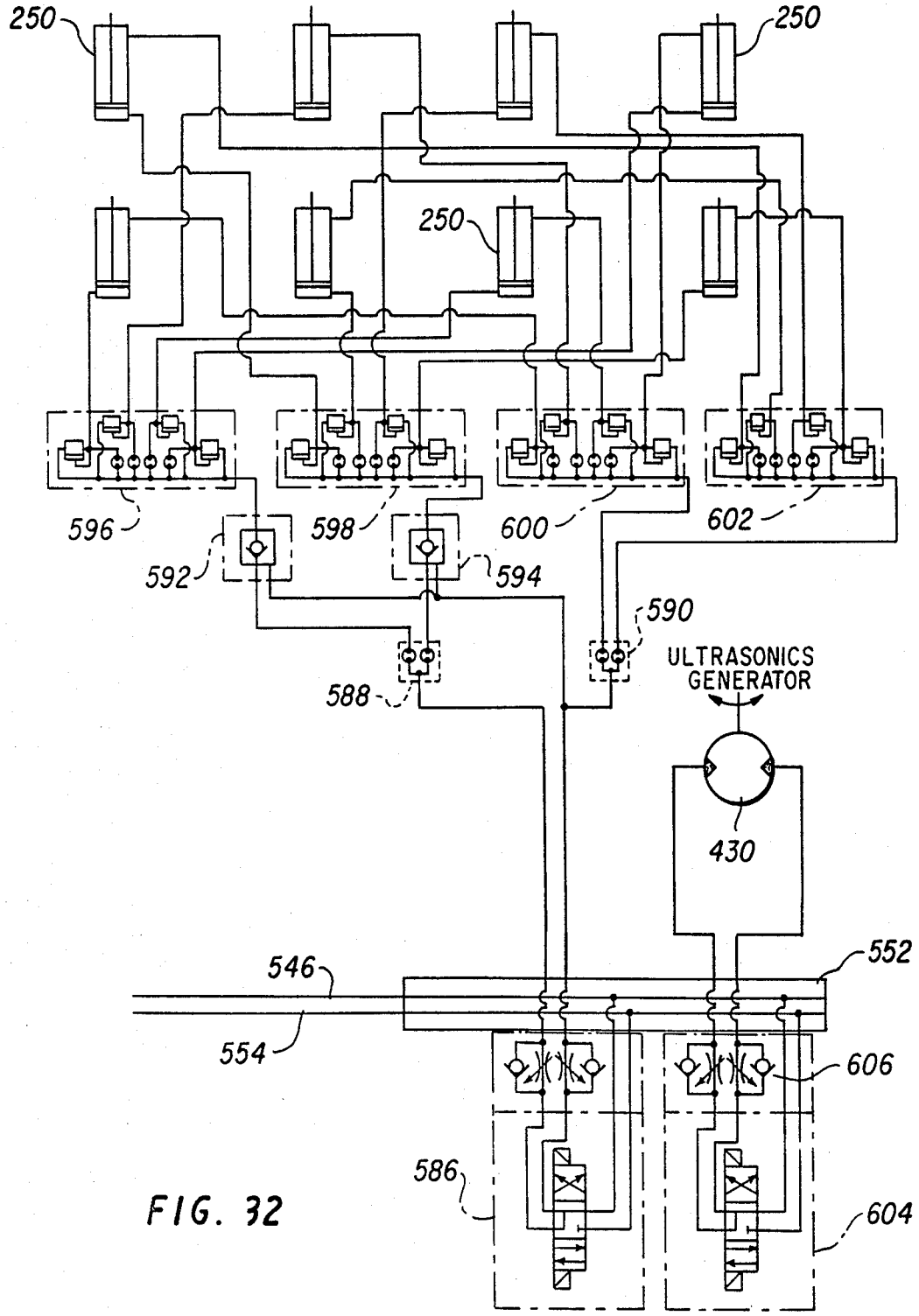
FIG. 32 is a diagram of a third portion of the hydraulic control circuit employed in the apparatus of FIG. 1.

The hydraulic circuitry is shown in FIGS. 30, 31 and 32 wherein the inlet of the hydraulic pump 178 is connected by a filter 540 to the reservoir 176. The output of the pump 178 as applied to an overpressure relief valve 542, a pressure gauge 544 and output line 546 to manifolds 548, 550 (FIG. 31) and 552 (FIG. 32). A return line 554 returns the hydraulic fluid from outlets of the manifolds 548, 550 and 552 through a filter 556 to the reservoir 176. Three-way solenoid valves 558 and 560 have inputs connected to the manifold 548 and have outputs connected through respective flow control devices 562 and 564 to the respective rear pusher motor 324 and rear elevator motor 344. In FIG. 31, solenoid valves 566, 568, 570, 572 and 574 have inputs connected to the manifold 550 and have outputs connected through respective flow control devices 576, 578, 580, 582 and 584 to inputs of the reversible motors 358, 530, 298, 307 and 532. In FIG. 32, a three-way solenoid valve 586 has inputs connected to the manifold 550 and has its outputs connected to flow dividers 588 and 590. The outputs of the flow divider 588 are connected through check valves 592 and 594 to quad flow dividers 596 and 598 which have outputs connected to the advance side of the hydraulic cylinders 250 for lifting the tank track section. The flow divider 590 has outputs connected to quad flow dividers 600 and 602 which has outputs connected to the retract inputs of the hydraulic cylinders 250. Also the retract pressure output of valve 586 is applied to inputs of the check valves 592 and 594 to open the check valves to permit the hydraulic cylinders 250 to lower. A three-way solenoid valve 604 has inputs connected to the manifold 550 and outputs connected to a flow control device 606 to inputs of the ultrasonic generator 430.

Figure 33:
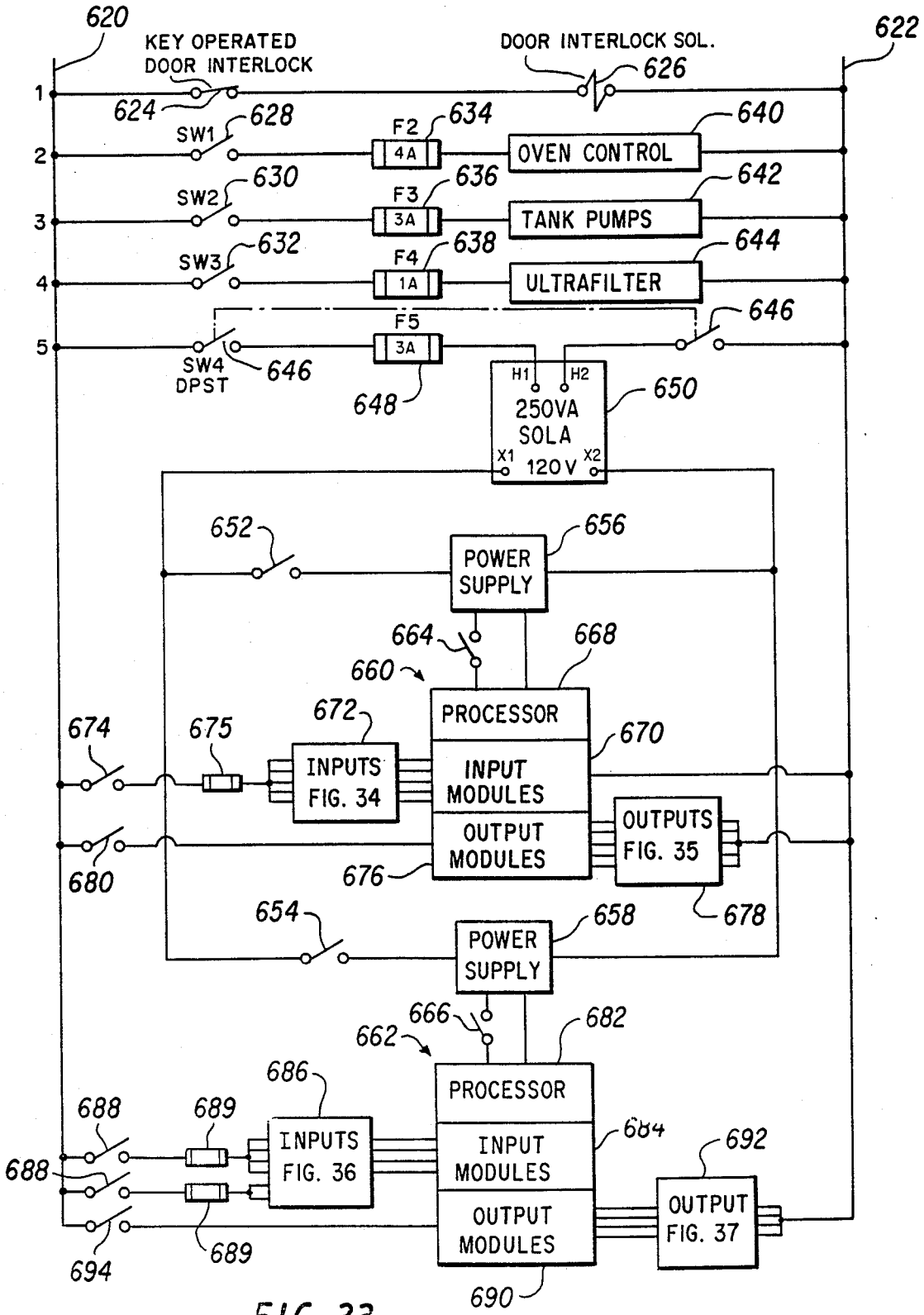
FIG. 33 is an electrical diagram of an electrical control circuit employed in the apparatus of FIG. 1.

The electrical control circuitry, shown in FIG. 33, is mainly disposed within the electrical cabinet 182, FIG. 5. The circuitry is energized by conventional 120 volt AC power on lines 620 and 622. The electrical cabinet includes a key switch 624 which operates a door locking solenoid 626 for preventing the door of the cabinet from being opened. Additionally, toggle switches 628, 630 and 632 are connected between lines 620 and 622 in series with respective fuses 634, 636 and 638 to an oven control circuit 640, a tank pump controller circuitry 642, and an ultra filter valve operating circuit 644, respectively. A double pole switch 646 in series with a fuse 648 connects the lines 620 and 622 to inputs of a voltage surge and filtering circuit 650 which provides power through switches 652 and 654 to respective power supplies 656 and 658 energizing a pair of programmable controllers indicated generally at 660 and 662 through toggle switches 664 and 666. The programmable controller 660 includes a processor unit 668 within input modules 670 having inputs connected in series with respective switches or contacts in a circuit 672 connected in series with a switch 674 and fuse 675 with the lines 620 and 622, and with output modules 676 connected in series with respective solenoids, relays and indicators in circuit 678 and a switch 680 across the lines 620 and 622. The programmable controller 662 includes a processor unit 682 with input modules 684 having inputs connected in series with various switches and contacts in an input circuit 686 in series with switches 688, fuses 689, and with output modules 690 having outputs connected in series with solenoids, relays and indicators in an output circuit 692 connected in series with a switch 694 across the lines 620 and 622. The programmable controller 660 and 662 are conventional controllers which continuously cycle through a program reading the inputs 672 and 686, and then based upon conditions, as programmed, operate the outputs 678 and 692.

Figure 34:
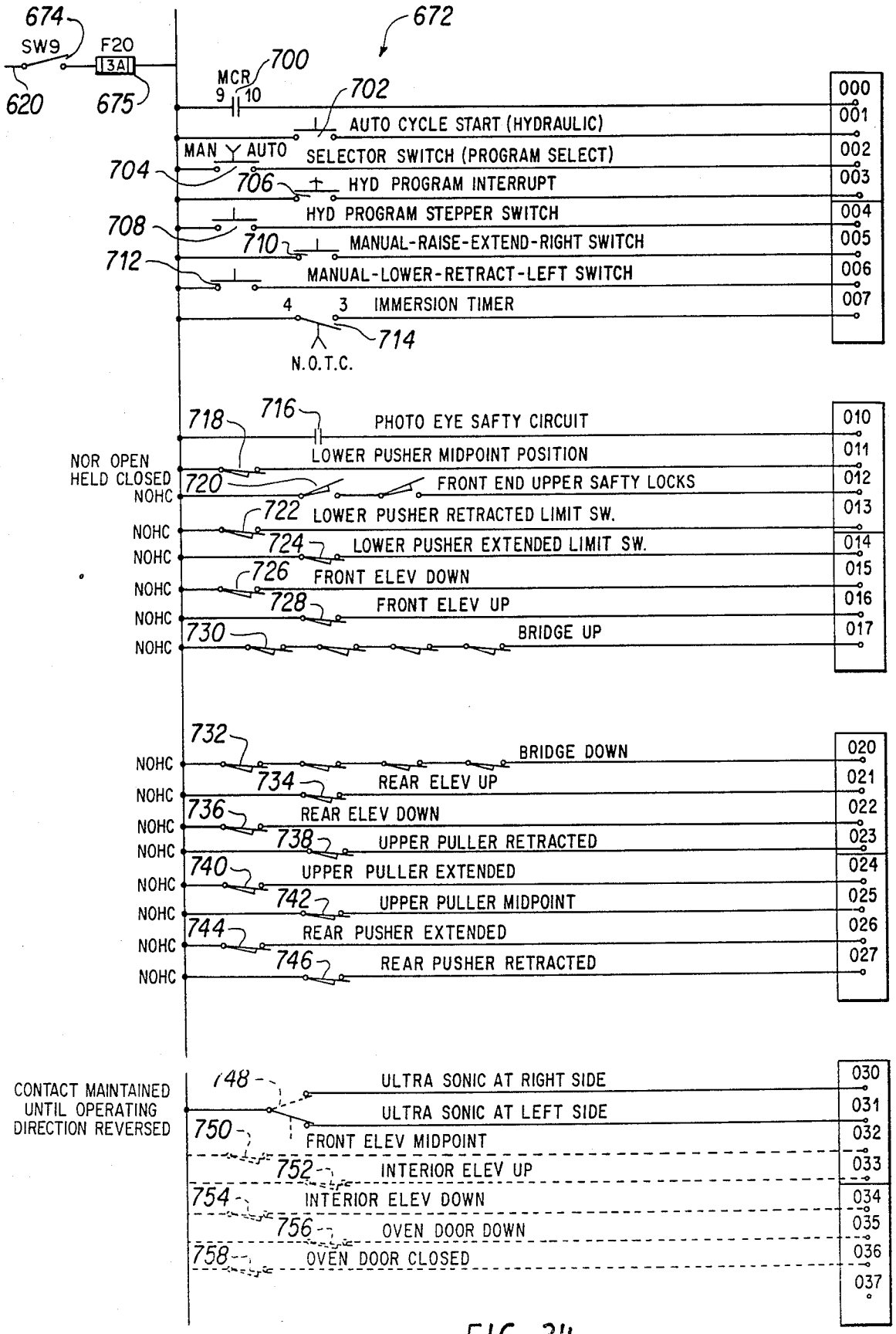
FIG. 34 is an electrical diagram of inputs connected to programmer input modules of a first programmable controller in the circuit of FIG. 33.

Various input switches in the input circuit 672 are shown in FIG. 34. Contacts 700 are normally open contacts of a master control relay. Pushbutton switch 702 is used for initiating an automatic operation of the apparatus. Toggle switch 704 determines whether the program operates in a manual or automatic mode. Interrupt pushbutton switch 706 serves to stop operation of the program. Switch 708 is a manually operated switch for stepping the program to thus debug the program and/or apparatus during initial set-up or subsequent service. Switch 710 is a manually operated switch located in the front loading area for being operated when a carrier has been loaded with articles so that the carrier may be advanced by the front pusher mechanism and the elevator may then be raised to receive another carrier. Pushbutton switch 712 is also located in the work area and enables an operator to initiate lowering of the front elevator for unloading articles and loading new articles thereon as well as to retract the pusher into a position for advancing the next carrier after loading is completed. Contacts 714 are on a timer which is set to produce the desired time that the bridge is down and the articles are plated or coated within the bath. Normally open contacts 716 are in a photo-eye safety circuit which detects an obstruction above the tank. Limit switch 718 detects when the lower front pusher mechanism is in the mid-point or mid-position. Safety switches 720 are used to sense that the elevator mechanism is securely fastened on the front end. Limit switch 722 is used to detect when the lower front pusher is in a retracted position, while limit switch 724 is positioned to detect the lower pusher in the extended or advanced position. Limit switch 726 is positioned to detect when the front elevator is in the down position while limit switch 728 is positioned to detect when the front elevator is in the up position. The four limit switches 730 and the four limit switches 732 are positioned adjacent the four corners of the tank track section; the switches 730 detecting when the track is in the up position while the switches 732 are positioned to detect when the tank track is in its down position. Limit switch 734 is positioned to detect when the rear elevator is up while limit switch 736 is positioned to detect when the rear elevator is down. Limit switch 738 is positioned to detect when the upper oven puller is in the retracted position, while limit switch 740 is positioned to detect when the upper puller is in the extended position. Limit switch 742 is used to detect when the upper puller is in the mid-point. Limit switch 744 is used to detect when the rear lower pusher is extended while limit switch 746 is positioned to detect when the rear lower pusher is retracted. Double throw switch 748 is used to determine when the right side or left side, respectively, of the ultrasonic generator is operated. Limit switches 750, 752, 754, 756 and 758 are used in the modification of FIG. 24 and in particular are positioned so as to sense the front elevator in a mid-point, the interior elevator up, the interior elevator down, the oven door down and the oven door closed, respectively.

Figure 35:
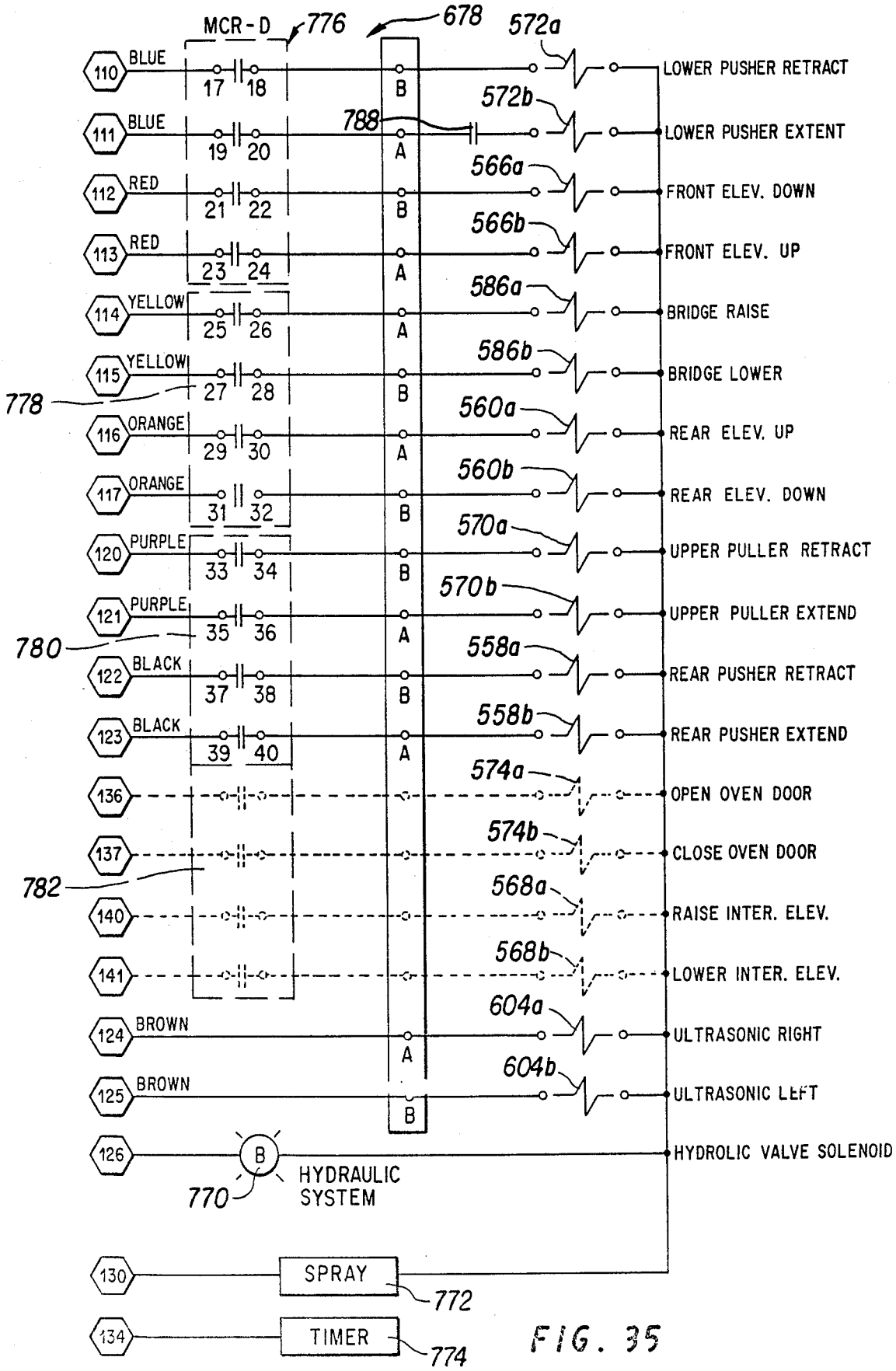
FIG. 35 is a diagram of output connections from output modules of a first programmer in FIG. 33.

The output circuit 678 is illustrated in FIG. 35. Solenoids 572*a* and 572*b* control the solenoid valve 572 for retracting the lower pusher and advancing the lower pusher, respectively. Solenoid 566*a* of the front elevator control valve 566 controls down movement of the elevator, while solenoid 566*b* controls upward movement of the front elevator. Raising and lowering of the bridge or tank track section is controlled by solenoids 586*a* and 586*b* of the bridge control solenoid valve 586. Solenoids 560*a* and 560*b* of the rear elevator control valve 560 control respective up and downward movement of the rear elevator. Upper puller retraction and advancement is controlled by respective solenoids 570*a* and 570*b* of the upper puller control valve 570. The rear pusher solenoid valve 558 has solenoids 558*a* and 558*b* for producing respective retraction and advancement of the rear pusher. Solenoids 574*a* and 574*b* cause respective opening and closing of the roll-up oven door. Solenoids 568*a* and 568*b* of a interior elevator control valve 568 cause respective raising and lowering of this elevator. Solenoid valve 604*a* and 604*b* control energization of the respective right and left sides of the ultrasonic generator. Additionally, outputs include an output energizing an indicator light 770 which indicates activation of the hydraulic system, and an output controlling operation of the spray control solenoid 772, and an output operating the timer 774 to begin a timing period for timing the operation of the plating current. Normally open contacts of respective control relays 776, 778, 780 and 782 are connected in series with the respective solenoids 572*a*, 572*b*, 566*a*, 566*b*, 586*a*, 586*b*, 560*a*, 560*b*, 570*a*, 570*b*, 558*a*, 558*b*, 574*a*, 574*b*, 568*a* and 568*b*, for preventing operation of these solenoids in the event that the master control relay is in a state preventing operation of the apparatus. Additionally, normally open contacts 788 of the protective photodetecting circuit for detecting an obstruction above the tank is in series with the solenoid 572b for preventing advancement of the lower pusher in the event of such an obstruction.

Figure 36:
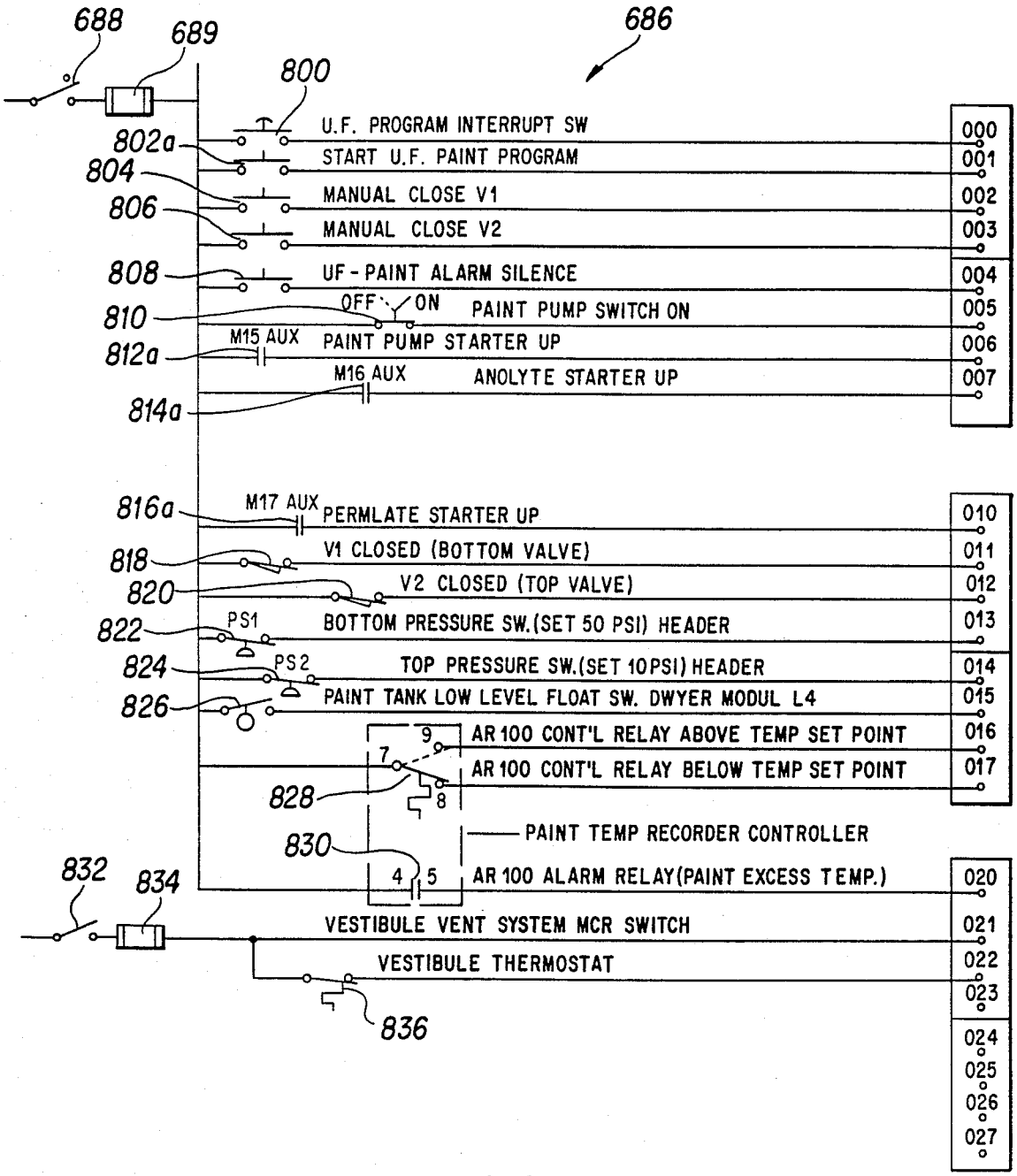
FIG. 36 is a diagram of inputs to input modules of a second programmer in the circuit of FIG. 33.

The input circuit 686 is illustrated in FIG. 36. A pushbutton switch 800 calls for interruption of the ultra filter operation. Pushbutton switch 802 starts operation of the ultra filter and paint circulation pump. Switch 804 will close the valve controlling flow of paint to the bottom of the ultra filter, while switch 806 will close a valve controlling flow of paint to the top of the ultra filter. Pushbutton switch 808 will cause silencing of an alarm indicating a failure of the ultra filter or paint system. Toggle switch 810 is used to turn on or off the paint circulation pump. Relay contacts 812*a*, 814*a* and 816*a* indicate when the respective paint pump, analyte pump and permeate pump are operated. Limit switches 818 and 820 detect when the respective bottom and top valves for the ultra filter are closed. A pressure switch 822 is used to detect an excessive bottom pressure in the ultra filter, while a pressure switch 824 is to detect an excessive top pressure in the ultra filter. Level sensitive switch 826 detects a low level of paint within the paint tank. Thermostat switch 828 detects whether the paint temperature is above the set point or the paint temperature is below the set point, while a temperature sensitive switch 830 detects when the paint temperature exceeds a maximum permissible temperature. Switch 832 connected to the controller modules through fuse 834 is used to operate a vestibule thermostat 836 which in turn controls the operation of an exhaust blower for the vestibule or front area of the plating machine.

Figure 37:
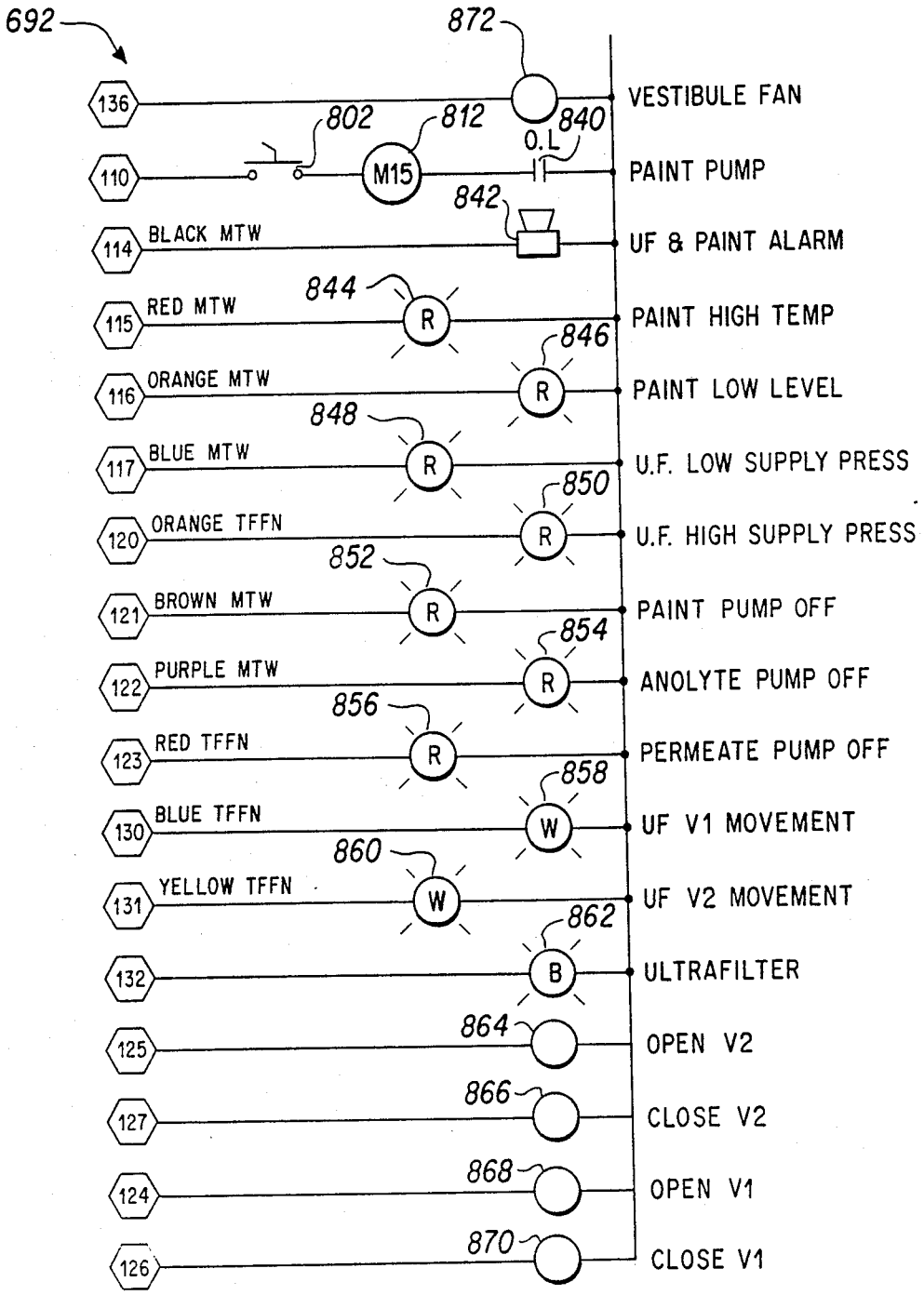
FIG. 37 is a diagram of outputs from output modules of the second programmer in the circuit of FIG. 33.

The output circuit 692 is shown in FIG. 37. One output is connected with the contacts 802 of the paint on-off toggle switch for operating the paint pump controller 812 which is connected in series with an overload protecting contact 840 of the paint circulation pump. Other outputs operate an ultra filter and paint alarm 842, a paint high temperature indicator 844, a paint low level indicator 846, an ultra filter low supply pressure indicator 848, an ultra filter high supply pressure 850, a paint pump off indicator 852, an anolyte pump off indicator 854, a permeate pump off indicator 856, an ultra filter bottom valve movement indicator 858 an ultra filter top valve movement indicator 860, and an ultra filter operation indicator 862. Additionally, outputs are connected to a relay 864 for opening the top ultra filter valve, relay 866 for closing the top ultra filter valve, relay 868 for opening the bottom ultra filter valve and relay 870 for closing the bottom ultra filter valve. Another output controls the vestibule fan contactor 872.

Figure 38:
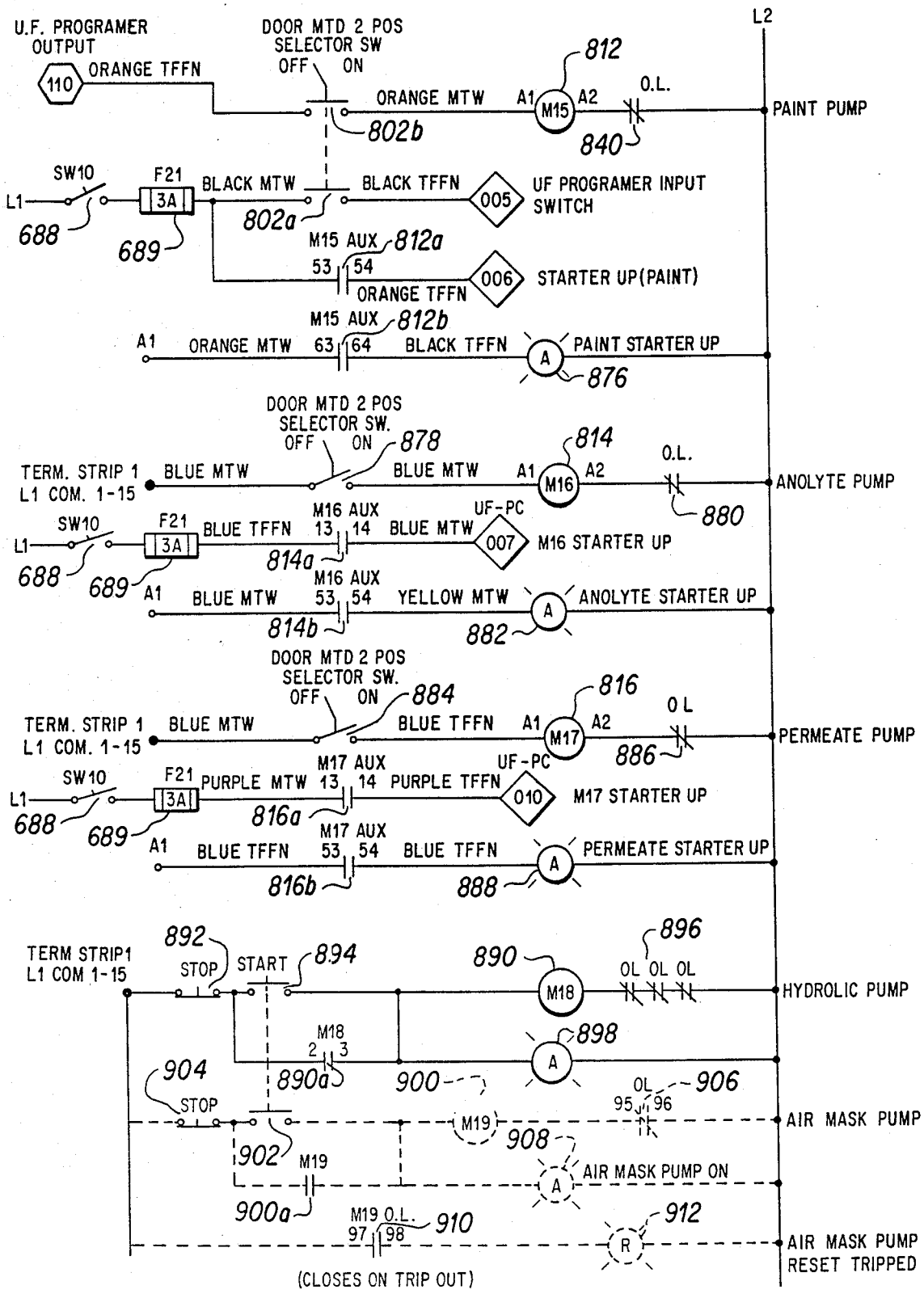
FIG. 38 is a diagram illustrating additional control circuitry of the apparatus of FIG. 1.

FIG. 38 illustrates some additional circuitry employed in controlling the operation of the paint pump, anolyte pump, permeate pump and hydraulic pump. The paint pump control relay 812 also includes a contact 812*b* which operates an indicator 876 indicating that the paint pump is in operation. For the anolyte pump, manual on-off switch 878 operates the anolyte pump control relay 814 which is in series with overload protecting contacts 880. Contacts 814*b* of the relay 814 operate an indicator 882 to indicate that the anolyte pump is in operation. On-off switch 884 operates the permeate pump control relay 816 which is in series with overload protecting contacts 886. Contacts 816*b* of the relay 816 are in series with an indicator 888 for indicating operation of the permeate pump. Hydraulic pump control relay 890 is connected in series with the stop switch 892 and start switch 894 together with overload protecting contacts 896. Contacts 890*a* of the relay 890 provide a bypass of the start switch 894 to maintain operation of the relay 890 upon release of the switch 894 and to also operate an indicator 898 which indicates that the hydraulic pump is in operation. Air mask blower control relay 900 is connected in series with start contacts 902 and stop contacts 904 together with overload protective contacts 906. Normally open contacts 900*a* of the relay 900 provide for bypass of the start contacts 902 to maintain the relay 900 energized as well as to energize an indicator 908 which indicates that the air mask blower is operating. Contacts 910 operate an indicator 912 for indicating that the air mask pump has been tripped off.

Figure 39:
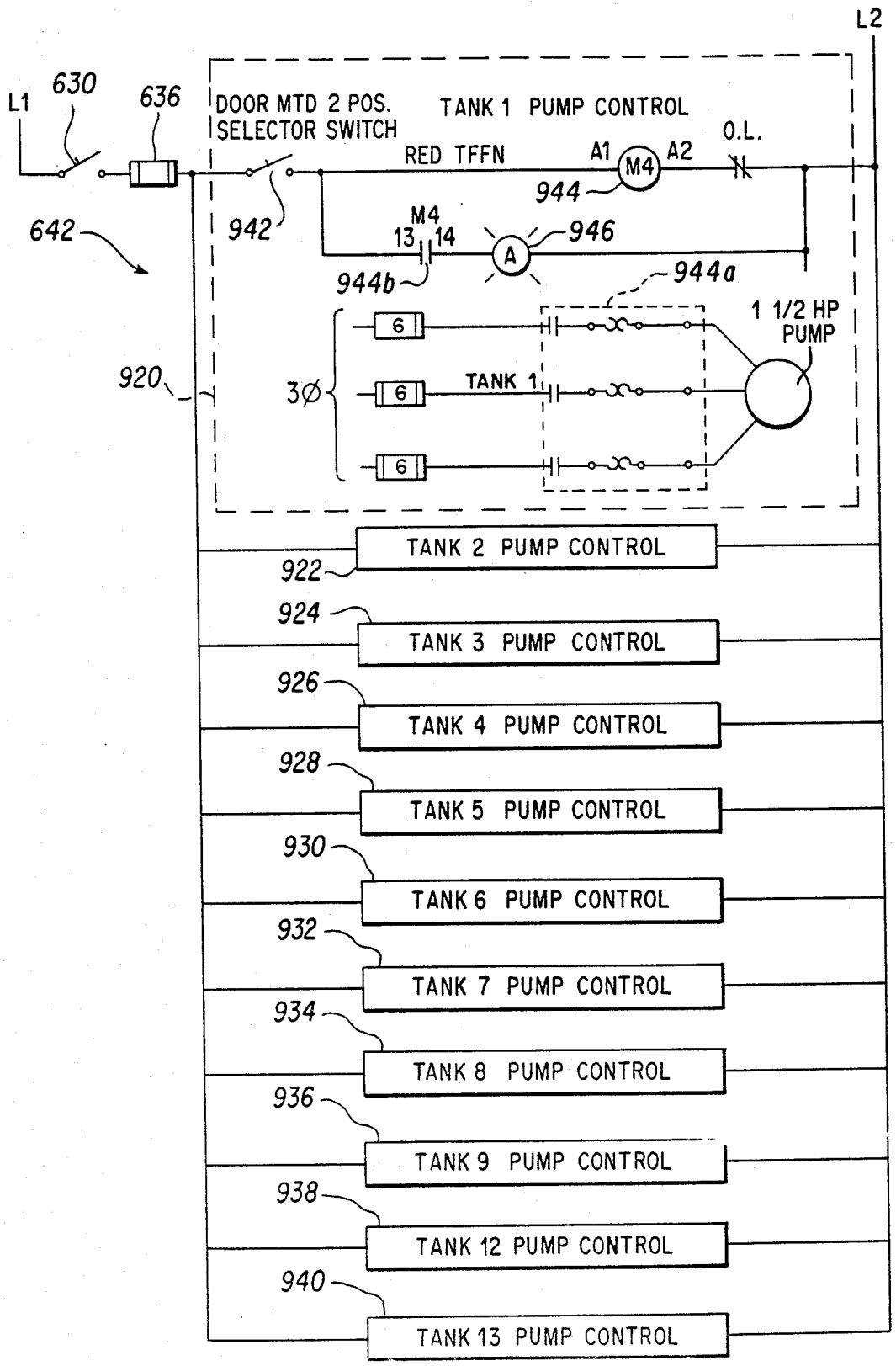
FIG. 39 is a diagram illustrating control circuitry for controlling circulation pumps in the circuit of FIG. 33.

The tank pump control circuit 642 is illustrated in FIG. 39 and includes control circuits 920, 922, 924, 926, 928, 930, 932, 934, 936, 938 and 940 for the circulation pump of the respective first, second, third, fourth, fifth, sixth, seventh, eighth, ninth, twelfth and thirteenth tank compartments. Each of these tank control circuits, as illustrated for circuit 920 controlling the circulation pump of tank 1 includes an operating toggle switch 942 which operates a contacter relay 944 having contacts 944a in series with the three phases of the windings, fuses and overload protective devices. Additionally, a contact 944*b* of the relay 944 operates an indicator 946 to indicate operation of the respective tank circulation pump.

Figure 40:
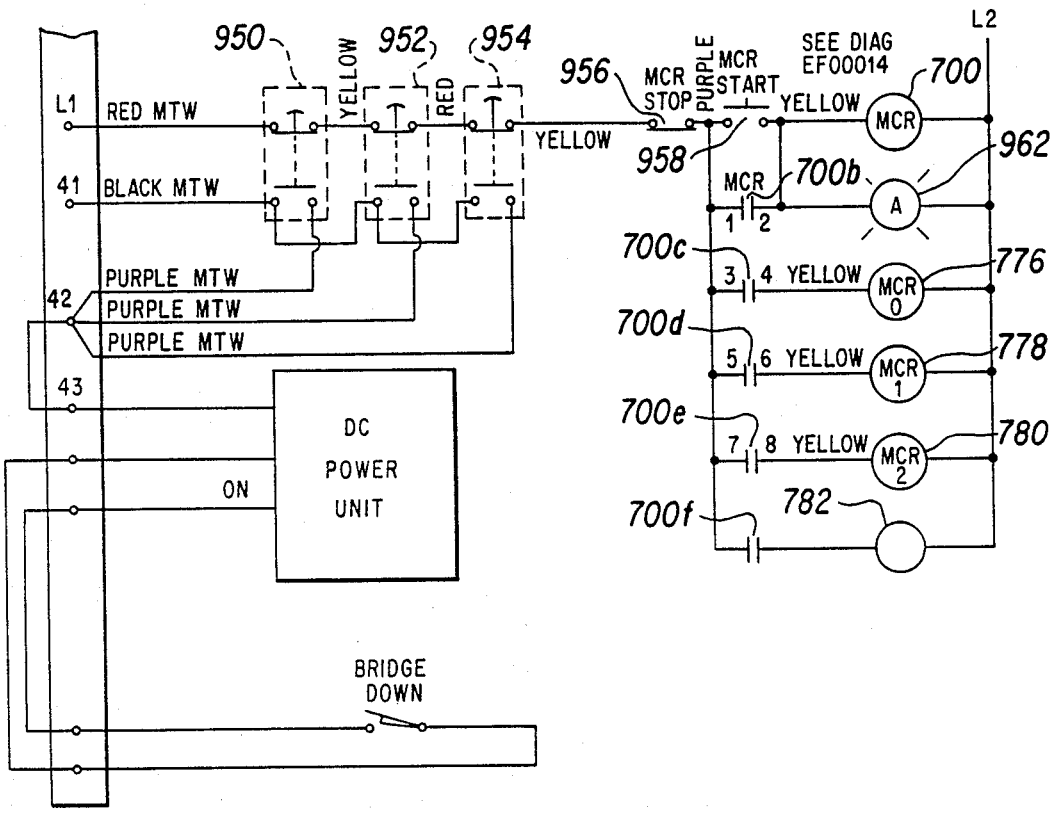
FIG. 40 is a diagram illustrating safety control circuit for controlling operation of the circuitry as well as a commercial DC plating power unit in the apparatus of FIG. 1.

An overall master control circuit is illustrated in FIG. 40 and includes respective emergency stop safety switches 950, 952 and 954 which are located on the main control box, front, and rear, respectively, of the apparatus and are connected in series with a master control relay stop switch 956 and a master control relay start switch 958 and the master control relay 700. Contacts 700*b* of the relay 700 form a bypass for the start switch 958 to maintain operation of the relay 700 and to also operate an indicator 962 indicating that the apparatus is in operation. Contacts 700*c*, 700*d*, 700*e* and 700*f* of the relay 700 operate the respective master control relays 776, 778, 780 and 782, see also FIG. 35.

Figure 41:
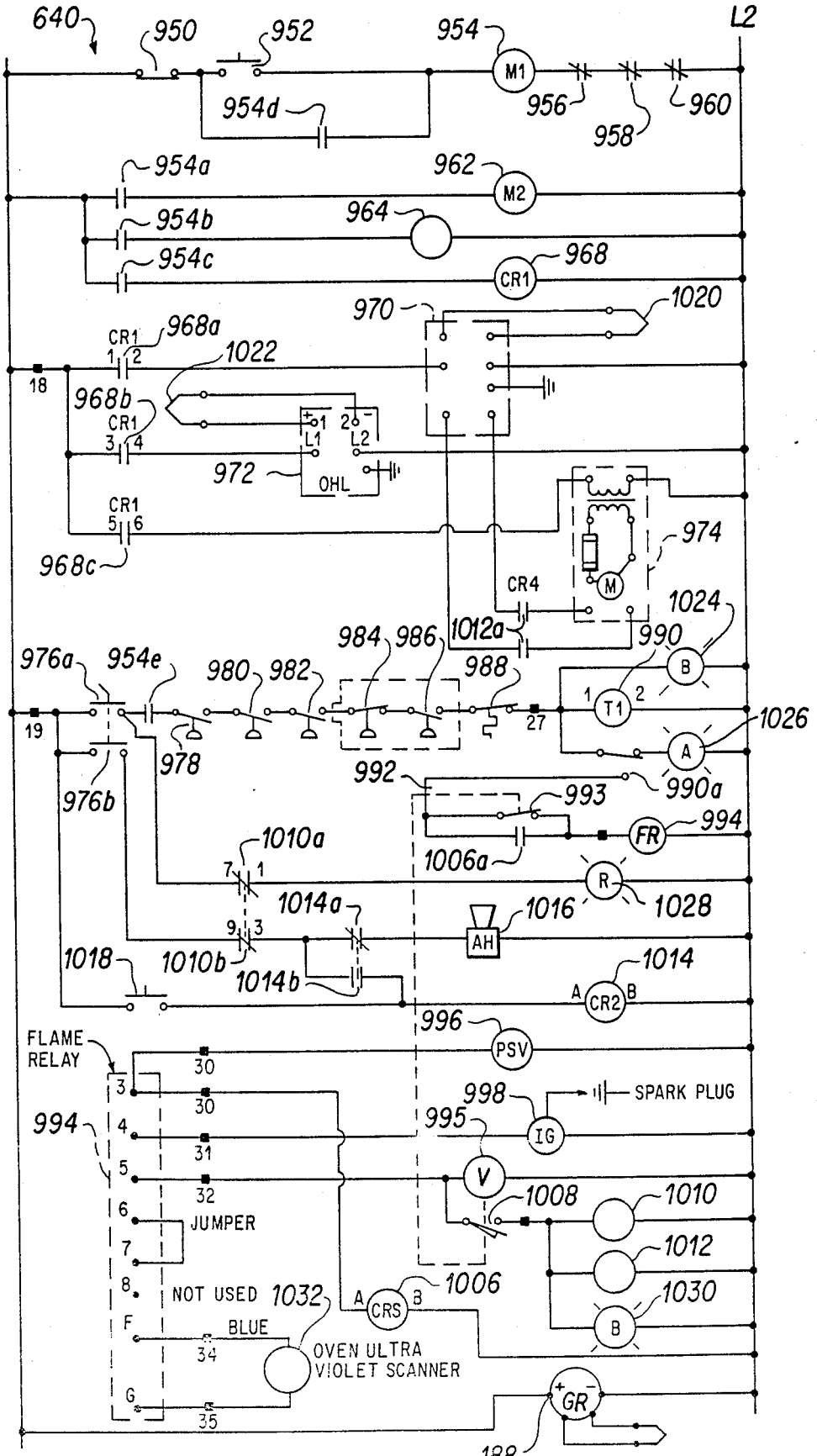
FIG. 41 is a diagram of oven control circuitry employed in the circuit of FIG. 33.

The oven control circuitry illustrated in FIG. 41 includes a normally closed stop pushbutton fan switch 950 in series with a normally open start pushbutton fan switch 952, oven circulation fan contactor 954 and motor overload protective contacts 956, 958 and 960 for the respective oven combustion blower, oven exhaust fan (not shown), and air circulation motor 380. Contacts 954*d* of relay 954 are connected across switch 952 for holding relay 954. Contactors 962 and 964 for the respective oven combustion blower and oven exhaust fan motor are connected in series with the contacts 954*a* and 954*b* of the relay 954. Contacts 954*c* operate a relay 968 which closes contacts 968*a* operating an oven heat controller 970, contacts 986*b* operating an oven high limit controller 972, and contacts 968*c* operating an oven burner modulating unit 974. A burner control toggle switch 976*a* is connected in series with contacts 954*e* of the relay 954, an exhaust fan pressure sensing switch 978, a circulation fan pressure switch 980, a combustion blower pressure switch 982, a high gas pressure switch 984, a low gas pressure switch 986 and an excessive high temperature switch 988 in series with a timer 990 set to delay ignition to purge the burner upon starting. Contacts 990*a* of the timer connect the point 992 through switch 993, closed when gas valve 995 is closed, to a flame relay 994. The flame relay 994 operates a pilot solenoid valve 996, a spark plug 998, the motorized gas valve 995, and relay 1006 in a conventional manner. Relay contacts 1006*a* maintain operation of the flame relay. Switch 1008, closed by opening of the gas valve 995, operates relays 1010 and 1012. Contacts 1012*a* of the relay 1012 enable the oven controller 970 to operate the burner modulator 974. Contacts 976*b* of the burner control switch are connected in series with normally closed contacts 1010*b*, normally closed contacts 1014*a* and oven alarm 1016. A pushbutton alarm silencing switch 1018 is connected in series with a relay 1014 which also has normally open holding contacts 1014*b*. The circuit also includes oven temperature sensors 1020 and 1022 for controllers 970 and 972, burner OK indicator lamp 1024, oven purger indicator lamp 1026, flame out indicator lamp 1028, burner on indicator lamp 1030, and flame ultra-violet sensor 1032.

The coating apparatus can operate in either an automatic mode or a manual mode. To start the machine in automatic operation, there should be a carrier on the front elevator, a carrier on the dead spot, and the lower pusher and the upper puller at their midpoints. When the above conditions are true, then the operator pushes the start button 702 (programmer input 001) with the selector button 704 (programmer input 002) switched to Auto. The machine starts its cycle when certain inputs are made: interior elevator up or down (programmer input 033 or 034); lower pusher extended or front elevator midpoint (programmer input 015 or 032); rear pusher retracted (programmer input 27); upper puller midpoint (programmer input 25); lower pusher midpoint or retracted (programmer input 011 or 013); and bridge down (programmer input 020).

The following is a list of steps employed in the programmer 660 to control automatic operation of the coating apparatus.

AUTO CYCLE

| STEP NUMBER | ACTIVITY | OUTPUTS ENERGIZED | INPUTS NEEDED TO BE MADE TO GO TO NEXT STEP |
|---|---|---|---|
| 1 | RAISE REAR ELEVATOR | 116 | 021 |
| | CLOSE OVEN DOOR | 137 | |
| 2 | RAISE REAR ELEVATOR | 116 | 023, 012 |
| | RETRACT UPPER PULLER | 120 | |
| 3 | RAISE REAR ELEVATOR | 116 | 025 |

-continued

| | | | |
|---|---|---|---|
| | EXTEND UPPER PULLER | 121 | |
| 4 | LOWER REAR ELEVATOR | 117 | 022 |
| 5 | EXTEND REAR PUSHER | 123 | 026 |
| 6 | RETRACT REAR PUSHER | 122 | 027 |
| 7 | EXTEND REAR PUSHER | 123 | 026 |
| 8 | RETRACT REAR PUSHER | 122 | 027 |
| 9 | WAIT FOR EXTERNAL TIMER | 134 | 007 |
| 10 | RAISE FRONT ELEVATOR | 113 | 032, 033, 017, 013 |
| | RAISE MID ELEVATOR | 140 | |
| | RAISE BRIDGE | 114 | |
| | RETRACT LOWER PUSHER | 110 | |
| 11 | RAISE MID ELEVATOR | 140 | 014, 016 |
| | RAISE BRIDGE | 114 | |
| | EXTEND LOWER PUSHER | 111 | |
| | RAISE FRONT ELEVATOR AFTER PUSHER REACHES INPUT 011 | 113 | |
| 12 | RAISE FRONT ELEVATOR | 113 | 024, 011 |
| | LOWER MID ELEVATOR | 141 | |
| | LOWER BRIDGE | 115 | |
| | RETRACT LOWER PUSHER | 110 | |
| | OPEN OVEN DOOR | 136 | |
| | (EXTEND UPPER PULLER AFTER FRONT ELEVATOR TO 016) | 121 | |
| 13 | LOWER FRONT ELEVATOR | 112 | 015, 025 |
| | LOWER BRIDGE | 115 | |
| | RETRACT UPPER PULLER | 120 | |

PROGRAMMER INPUTS AND OUTPUTS

| INPUTS | OUTPUTS |
|---|---|
| 000 MCR | 110 RETRACT LOWER PUSHER |
| 001 CYCLE START BUTTON | 111 EXTEND LOWER PUSHER |
| 002 MANUAL/AUTO BUTTON | 112 LOWER FRONT ELEVATOR |
| 003 PROGRAM INTERRUPT | 113 RAISE FRONT ELEVATOR |
| 004 STEPPER BUTTON | 114 RAISE BRIDGE |
| 005 RAISE-EXT-ULT-OPEN | 115 LOWER BRIDGE |
| 006 LOWER-RET-ULT-CLOSE | 116 RAISE REAR ELEVATOR |
| 007 EXTERNAL TIMER | 117 LOWER REAR ELEVATOR |
| 010 SAFETY EYE FOR LOWER PUSHER | 120 RETRACT UPPER PULLER |
| 011 LOWER PUSHER - MIDPOINT | 121 EXTEND UPPER PULLER |
| 012 FRONT END UPPER SAFE LOCKS | 122 RETRACT REAR PUSHER |
| 013 LOWER PUSHER - RETRACTED | 123 EXTEND REAR PUSHER |
| 014 LOWER PUSHER - EXTENDED | 124 ULT SONIC-MOVE RIGHT |
| 015 FRONT ELEV - DOWN | 125 ULT SONIC-MOVE LEFT |
| 016 FRONT ELEV - UP | 126 HEART BEAT |
| 017 BRIDGE - UP | 127 SPRAY-BRIGDE RISE/LWR |
| 020 BRIDGE - DOWN | 130 SPRAY PERM/CLOSE EDUCTOR |
| 021 REAR ELEV - UP | 131 LOWER PUSHER MID LIGHT |
| 022 REAR ELEV - DOWN | 132 UPPER PULLER MID LIGHT |
| 023 UPPER PULLER - RETRACTED | 133 ZINC ADDITION PUMPS |
| 024 UPPER PULLER - EXTENDED | 134 OUTPUT TO EXT TIMER |
| 025 UPPER PULLER - MIDPOINT | 135 DI SPRAY LAST TANK |
| 026 REAR PUSHER - EXTENDED | 136 OPEN OVEN DOOR |
| 027 REAR PUSHER - RETRACTED | 137 CLOSE OVEN DOOR |
| 030 ULT SONIC - RIGHT SIDE | 140 RAISE MIDDLE ELEV |
| 031 ULT SONIC - LEFT SIDE | 141 LOWER MIDDLE ELEV |
| 032 FRONT ELEV - MIDPOINT | |
| 033 MIDDLE ELEV - UP | |
| 034 MIDDLE ELEV - DOWN | |
| 035 OVEN DOOR - OPEN | |
| 036 OVEN DOOR - CLOSED | |

To run the machine manually, the Operator moves the Selector Switch to Manual (programmer input 002). The Operator pushes the Stepper Button (programmer input 004) to select which part of the machine he wants to run. He then uses buttons (programmer input 005) or (programmer input 006) to control that part of the machine.

OTHER INPUTS:

| | |
|---|---|
| 000 | Master Control Relay (Controls all Outputs). |
| 003 | Interrupts any machine movement. Resets Ext. Timer. |
| 010 | Interrupts any machine movement. |
| 012 | On when locks are down for safety on front elevator. |
| 030, 031 | Limits for Ultrasonic Traverse in first cleaning tank. |

OTHER OUTPUTS:

| | |
|---|---|
| 124 | On when Ultrasonics are traveling riqht. (During automatic cycle). |
| 125 | On when Ultrasonics are traveling left. (During automatic cycle). |
| 126 | Blinking light indicating Auto Operation. |
| 127, 130, 135 | Spray sol working from internal computer timers. |

-continued

| | |
|---|---|
| 131 | Light indicating position of lower pushers. |
| 132 | Light indicating position of upper pullers. |
| 133 | Used to turn on zinc addition metering pumps. (During auto cycle). |

The program for the controller 662 monitors the various inputs and operates the corresponding indicator lamps and the alarm 842 in a conventional manner. Additionally, the program controls the ultrafilter valves in a conventional manner to disconnect the ultrafilter and to backflush the ultrafilter when measured pressures indicate that such control is needed.

Since many modifications, variations and changes in detail may be made to the above-described embodiments, it is intended that all matter shown in the foregoing description and in the accompanying drawings be interpreted as illustrative and not in a limiting sense.

What is claimed is:

1. A transportable coating apparatus comprising an elongated support structure having lower and upper horizontal rectangular frames, vertical members interconnecting the horizontal frames, and a side longitudinal member mounted on and extending on one longitudinal side of the support structure, each frame including longitudinal members and transverse members interconnecting the respective longitudinal members;

an elongated unitary multi-compartment tank mounted on the lower horizontal frame, said tank including a series of contiguous tank compartments arranged in a straight line longitudinally in the support structure for containing selected treatment and coating fluids;

a first vertically movable horizontal track section extending longitudinally over the series of tank compartments;

means mounted on the support structure for raising and lowering the first vertically movable horizontal track section between raised and lowered positions;

an oven mounted on the upper horizontal frame and extending longitudinally above the series of tank compartments;

said oven including a stationary track section extending longitudinally through the oven;

a front elevator mountable on the support structure at the front end of the series of tank compartments and having a second vertically movable track section and means for raising and lowering the second vertically movable track section between a first position aligned with the stationary track section through the oven and a second position aligned with the first movable track section when the first movable track section is in the raised position;

a rear elevator mounted on the support structure at the rear end of the series of tank compartments and having a third vertically movable track section and means for raising and lowering the third vertically movable track section between an upper position aligned with the stationary track section through the oven and a lower position aligned with the first movable track section when the first movable track section is in the raised position;

a plurality of article carriers with roller means for movably mounting the carriers for horizontal movement on the first, second and third movable track sections and the stationary oven track section;

lower carrier advancing means for incrementally advancing the article carriers from the second movable track section in its second position, along the first movable track section in its raised position, and onto the third movable track section in its lower position;

upper carrier advancing means for incrementally advancing the article carriers from the third movable track section in its upper position, along the stationary track section through the oven, and then onto the second movable track section in it first position;

tank circulation and fluid handling means mounted on the side longitudinal member and connected with at least one of the tank compartments;

said support means including floor engaging means at front and rear ends thereof;

ground engaging wheels means attachable to one end of the support structure for carrying the one end of the support structure with the respective floor engaging means in a raised position;

coupling means attachable to the other end of the support structure and adapted to be connected to a tractor for carrying the other end of the support with the respective floor engaging means in a raised position so that the support structure, the multi-compartment tank, the oven, and the tank fluid handling and circulation means can be transported in an assembled condition over roadways from one location to another location; and door means separating a front opening of the oven from the front elevator, said door means including a flexible sheet material, and means for unrolling and rolling the flexible sheet material in order to close and open the front opening of the oven;

said unrolling and rolling means including a shaft rotatably mounted at the bottom of the front opening of the oven, a tube rotatably mounted on the shaft, spring means connected between the shaft and the tube and normally biasing the tube in a rotative position to roll-up the flexible sheet, a pair of first sprockets mounted on the shaft at respective opposite ends of the tube, a pair of second sprockets mounted on respective sides at the top of the front opening of the oven, a pair of chains extending on opposite sides of the front opening of the oven and passing over corresponding first and second sprockets of said pairs of first and second sprockets, means attaching one end of the flexible sheet at respective opposite sides to the chains, and reversible motor means for rotating one of the first and second pair of sprockets so that movement of the chains raises and lowers the sheet while rotation of the pipe unrolls and rolls the sheet.

2. An article coating apparatus comprising elongated multi-compartment tank means including a series of contiguous tank compartments arranged in a straight line for containing selected treatment and coating fluids;

a first vertically movable horizontal track section extending longitudinally over the series of tank compartments;

means for raising and lowering the first vertically movable horizontal track section between raised and lowered positions;

an oven mounted above and extending longitudinally over the series of tank compartments;

said oven including a stationary track section extending longitudinally through the oven;

a front elevator mounted at the front end of the series of tank compartments and having a second vertically movable track section and means for raising and lowering the second vertically movable track section to a first position aligned with the stationary track section through the oven, a second position aligned with the first movable track section when the first movable track section is in the raised position, and a third position below the second position in order to enable easy loading and unloading of articles on the carrier;

an intermediate elevator interposed between the front elevator and the front end of the tank and having a third vertically movable track section and means for raising and lowering the third vertically movable track section between a first position aligned with the first movable track section while when the first movable track section is in a raised position and a lower position for enabling easy loading of articles thereon, whereby additional time can be provided for loading and unloading articles on the carriers;

a rear elevator mounted at the rear end of the series of tank compartments and having a fourth vertically movable track section and means for raising and lowering the fourth vertically movable track section between an upper position aligned with the stationary track section through the oven and a lower position aligned with the first movable track section when the first movable track section is in the raised position;

a plurality of article carriers with roller means for movably mounting the carriers for horizontal movement on the first, second, third and fourth movable track sections and the stationary oven track section;

lower carrier advancing means for incrementally advancing the article carriers from the second movable track section in its second position, along the third movable track section in its raised position, along the first movable track section in its raised position, and onto the fourth movable track section in its lower position;

upper carrier advancing means for incrementally advancing the article carriers from the third movable track section in its upper position, along the stationary track section through the oven, and then onto the second movable track section in its first position; and tank circulation and fluid handling means connected with at least one of the tank compartments.

3. A coating apparatus as claimed in claim 2 including a stationary track section interposed between the first vertically movable track section and the fourth vertically movable track section at the rear end of the tank in order to provide an inspection station for the apparatus.

4. An article coating apparatus comprising:

elongated multi-compartment tank means including a series of contiguous tank compartments arranged in a straight line for containing selected treatment and coating fluids;

a first vertically movable horizontal track section extending longitudinally over the series of tank compartments;

means for raising and lowering the first vertically movable horizontal track section between raised and lowered positions;

an oven mounted above and extending longitudinally over the series of tank compartments;

said oven including a stationary track section extending longitudinally through the oven;

a front elevator mounted at the front end of the series of tank compartments and having a second vertically movable track section and means for raising and lowering the second vertically movable track section between a first position aligned with the stationary track section through the oven and a second position aligned with the first movable track section when the first movable track section is in the raised position;

a rear elevator mounted at the rear end of the series of tank compartments and having a third vertically movable track section and means for raising and lowering the third vertically movable track section between an upper position aligned with the stationary track section through the oven and a lower position aligned with the first movable track section when the first movable track section is in the raised position;

a plurality of article carriers with roller means for movably mounting the carriers for horizontal movement on the first, second and third movable track sections and the stationary oven track section;

lower carrier advancing means for incrementally advancing the article carriers from the second movable track section on its second position, along the first movable track section in its raised position, and onto the third movable track section in its lower position;

upper carrier advancing means for incrementally advancing the article carriers from the the third movable track section in its upper position, along the stationary track section through the oven, and then onto the second movable track section in its first position;

tank circulation and fluid handling means mounted on the side longitudinal member and connected with at least one of the tank compartments; and door means separating a front opening of the oven from the front elevator, said door means including a flexible sheet of heat resistant material, and means for unrolling and rolling the flexible sheet material in order to close and open the front opening of the oven;

said unrolling and rolling means including a shaft rotatably mounted at the bottom of the front opening of the oven, a tube rotatably mounted on the shaft, spring means connected between the shaft and the tube and normally biasing the tube in a rotative position to roll-up the flexible sheet, a pair of first sprockets mounted on the shaft at respective opposite ends of the tube, a pair of second sprockets mounted on respective sides at the top of the front opening of the oven, a pair of chains extending on opposite sides of the front opening of the oven and passing over corresponding first and second sprockets, means attaching one end of the flexible sheet at respective opposite sides to the chains, and reversible motor means for rotating one of the first and second pair of sprockets so that movement of the chains raises and lowers the sheet while rotation of the tube unrolls and rolls the sheet.

5. A coating apparatus as claimed in claim 4 wherein the sheet of flexible material is fiberglass having a silicone coating.

6. A coating apparatus as claimed in claim 4 wherein the oven includes a coating curing chamber, a return plenum extending on one side of the apparatus and having an entrance and an exit from respective front and rear portions of the curing chamber, blower means for circulating air through the curing chamber and the return plenum, and a burner at the entrance end of the return plenum.

* * * * *